US005911662A

United States Patent [19]

Hallsten

[11] Patent Number: 5,911,662

[45] Date of Patent: Jun. 15, 1999

[54] TANK COVER STRUCTURE

[75] Inventor: Jeffrey A. Hallsten, Sacramento, Calif.

[73] Assignee: Hallsten Corporation, Sacramento, Calif.

[21] Appl. No.: 08/835,290

[22] Filed: Apr. 7, 1997

Related U.S. Application Data

[63] Continuation of application No. 08/270,010, Jul. 1, 1994, Pat. No. 5,617,677, which is a continuation-in-part of application No. 07/932,491, Aug. 20, 1992, Pat. No. 5,325,646.

[51] Int. Cl.[6] ..... E04B 1/32

[52] U.S. Cl. ..... 52/246; 52/3; 52/5; 52/245; 52/281; 52/282.1; 52/395; 52/396.04; 52/586.1; 52/586.2; 52/592.1

[58] Field of Search ..... 52/3, 5, 23, 282.1, 52/283, 245, 246, 474, 483.1, 762, 763, 281, 395, 396.04, 586.1, 586.2, 592.1

[56] References Cited

U.S. PATENT DOCUMENTS 5,325,646 7/1994 Hallsten et al. ..... 52/246
5,617,677 4/1997 Hallsten ..... 52/246 X

*Primary Examiner*—Christopher Kent
*Attorney, Agent, or Firm*—Thomas M. Freiburger

[57] ABSTRACT

A cover for tank is formed from a plurality of panels attached together by cross members. The panels are sealed to the cross members, and the panels and the cross members are sealed to the tank. The panels are constructed from a multiplicity of edge-to-edge planks. The planks may be connected together without welds, and the panels may be connected to the cross members without welds. The cover may be in the shape of an arch, or the shape of a dome. In another embodiment a dome-shaped cover may be formed from a plurality of panels each having the shape of a section of a circle. Each panel is connected between an adjacent pair of a plurality of radial members arranged in a radial pattern.

9 Claims, 29 Drawing Sheets

TANK COVER STRUCTURE

REFERENCE TO RELATED APPLICATION

This application is a continuation of application Ser. No. 270,010, filed on Jul. 1, 1994, now U.S. Pat. No. 5,617,677, which was a continuation-in-part of application Ser. No. 932,491, filed Aug. 20, 1992, now U.S. Pat. No. 5,325,646.

BACKGROUND OF THE INVENTION

The present invention relates in general to a cover for a tank. It relates in particular to a modular cover which may be shipped to a site in component form and assembled at the site.

There is an increasing need for covers for enclosing in and above ground tanks which are used for storing waste materials including sewage, chemical sludge, petroleum products and the like. The materials are stored for later disposal or treatment. Such a cover must be substantially gas tight for controlling odors in the vicinity of a tank site and for trapping potentially hazardous gases.

Tanks used for storing such treatments may have a span or diameter of fifty feet or more. It is generally necessary to support a tank cover only at the edge of a tank. Because of this such a tank cover must be capable of spanning a large distance.

A tank cover is generally too large to be conveniently or cost effectively shipped in an assembled form from a manufacturer to a site where will be used. Because of this it is generally shipped as components and assembled at the site.

Prior art tank covers made of steel are heavy and expensive even to ship in component form. Further, such covers usually require welded connections and bolted connections in their assembly. As such, skilled personnel are generally necessary to carry out the assembly, and the assembly process may be lengthy and costly.

One approach to large-span tank covers and covers for similar purposes has been a geodesic dome type structure. These covers required skilled erecting labor and were quite costly as compared to the present invention.

There is a need for a site erectable substantially gas-tight tank cover which can be assembled with a minimum of welds or bolted connections. Such a cover should preferably be modular to reduce the inventory of components necessary for building covers in a wide range of shapes and sizes, and this is an object of the present invention described below.

U.S. Pat. No. 5,050,361, assigned to the assignee of the present invention, discloses a deck structure which is weldless and is site-erectable and which includes components similar to some of the components of the present invention. The disclosure of that patent is incorporated herein by reference.

SUMMARY OF THE INVENTION

The present invention is directed to a gas-tight cover for a tank or for other enclosures which may require spanning a large distance. The cover is designed to be shipped as a component package to a site where it will be used and erected at the site. The cover may be in the form of an arch or a dome and is configured to remain structurally sound and substantially gas-tight under repeated thermal cycling conditions.

Objects of the invention are accomplished by constructing the cover of components which may be connected together at the site without welds and with a minimum of bolted connections. Resilient seals between components of the cover and between the cover and the tank, serve to make the cover substantially gas-tight. The construction method and the seals also allow the cover to deflect under load to a predetermined extent for absorbing thermal expansion stresses and other environmental stresses to which the cover may be subjected.

In one preferred embodiment, the cover comprises a plurality of panels and a plurality of cross members. Each panel is formed by a multiplicity of planks connected together edge-to-edge. The panels are arranged side-by-side with adjacent panels connected together by a cross member. The ends of the cross members engage cover support means attached to the tank.

Each panel includes a side member extending transversely along at least one edge of the panel. The side member has plank receiving means therein. The side member and the cross member have interconnecting means therein for providing a substantially gas-tight connection between the panel and a cross member.

The panels include a sealing member which engages the cover support means for providing a substantially gas-tight seal between the cover and the tank.

The panels may be generally rectangular and the cross members configured to provide a cover having an arch-like form. Alternatively, each panel may be generally in the form of a section of a circle and the cross members configured to provide a cover having a dome-like shape.

In another embodiment of the invention, a dome-shaped cover for a tank is constructed from a plurality of panels, each generally in the shape of a segment of a circle and plurality of radial members arranged alternately in a radial pattern. Each panel includes a multiplicity of planks connected together edge-to-edge. Adjacent panels are connected together by a support member.

The radial members are preferably each clamped at one end thereof to a compression unit located at about the center of the radial pattern. The other end of the radial member engages a tension ring attached to the tank.

In a preferred embodiment, the compression unit includes a compression ring and upper and lower annular portions assembled concentrically around the compression ring such that the assembly forms an outward facing channel in the compression unit for receiving the ends of the radial members. The support members are clamped to the compression unit by means of wedge-shaped resilient blocks, bolted to the compression ring. One block is located between each pair of adjacent radial members. The blocks are configured such that when they are bolted to the compression ring they expand to clamp the ends of the radial members in the outward-facing channel of the compression unit.

The invention also encompasses seals at the edges of panels, slidably connected into side members, formed of rubber-like material. These seals, which can be formed in a family of different widths and heights, serve not only as gas seals but also as structural members in some preferred installations. In such installations the rubber-like extrusions, which may be formed of the material Santoprene manufactured by DuPont, have such material strength and are so configured structurally as to support the edge of an entire cover, which may be designed to support loads of, for example, 200 lbs. per lineal foot, without any of the metal structure bearing directly against the concrete or steel edge support for the tank or vessel, and in fact without any of the metal deck structure actually located directly over a lip of the tank or vessel edge. This arrangement not only satisfies the requirement that the metal cover structure (preferably aluminum) not be in direct contact with tank edge supporting structures such as steel or concrete so that corrosive effects and stray current electrolysis effects can be avoided, but it also uses not simply the compressive strength of the rubbery material but the sheer strength of the rubbery material in supporting the deck structure.

The entire perimeter of the deck structure of the invention is isolated material-wise from the surrounding support structure of the existing tank or weir.

In all of the above described embodiments, a preferred means for connecting a panels to a cross member or radial member includes an outwardly and downwardly hooking flange extending along the side member, and an outwardly and upwardly hooking flange extending along the cross member or radial member. The flanges are hooked together for connecting the panel to the cross member or radial member. Additionally, the side member and the cross member or radial member each include a slit extending along the members below the flanges. Each slit opens into a tube-like groove extending along the members. When the side member and the cross members or radial members are hooked together, the slits are substantially aligned with each other such that the slits and grooves together form an elongated interlocking space having a dumbbell shaped cross section. A resilient interlocking seal strip, also having a dumbbell shaped cross section, is inserted into the interlocking space for sealing the side member, and thus the panel, to the cross member or radial member. The seal strip, thus inserted effectively locks, the panel to the cross member or radial member and prevents the panel from being unintentionally disconnected therefrom.

In one embodiment of the invention a cover for an open-topped structure is formed without cross members, in a situation wherein a single span of planks provides the entire tank coverage. The tank may be long in the direction transverse to the planks, and the cover may be made up of a series of panels arranged end-to-end, but in this case the side members engage the tank's rim or edge, with isolation between the materials, to support the panel or panels. Thus, the side members serve to receive the ends of the planks and to hold the structure together, but have little other function, since the planks themselves are the only structural members in the sense of spanning across a distance. In a cover structure such as just described, as well as in other cover structures having multiple panels side-to-side and end-to-end, a structural plastic member acting in sheer connects adjacent panels, running in the direction parallel to the planks. The flexible plastic sheer members may comprise the plastic material ELVAX and are configured to engage against the "male" side of the tongue-in-groove plank edge at the extremity of a panel forming a bullnose-type shape for engaging between the "female" side of an adjacent plank from an adjacent panel in the large channel formed between the top and bottom of the plank.

DESCRIPTION OF PREFERRED EMBODIMENTS

The cover of the present invention and components for its construction, are described below in terms of preferred embodiments. The embodiments are constructed primarily from aluminum extrusions. It will be evident to those familiar with the pertinent art that a cover for a tank or other open-topped enclosure may be constructed from materials such as wood or steel, and assembled using traditional connections such as welds, screws or bolts. The cover of the present invention, however, is desired to be field erectable, at the location at which it is used, without the need for personnel having special skills. Because of this it is preferable that such a cover may be formed from lightweight components and assembled preferably without welds and with the minimum of bolted connections.

The cover is also desired to be resistant to atmospheric corrosion, and to corrosion by gases contained in a tank by the cover. Further, it is desired that the cover be easily configured to be adaptable to tanks in a range of different sizes and shapes, albeit generally rectangular or circular. It is for this reason that embodiments of the invention and components of the invention described below make maximum use of components which are readily extruded from aluminum.

Figure 1:
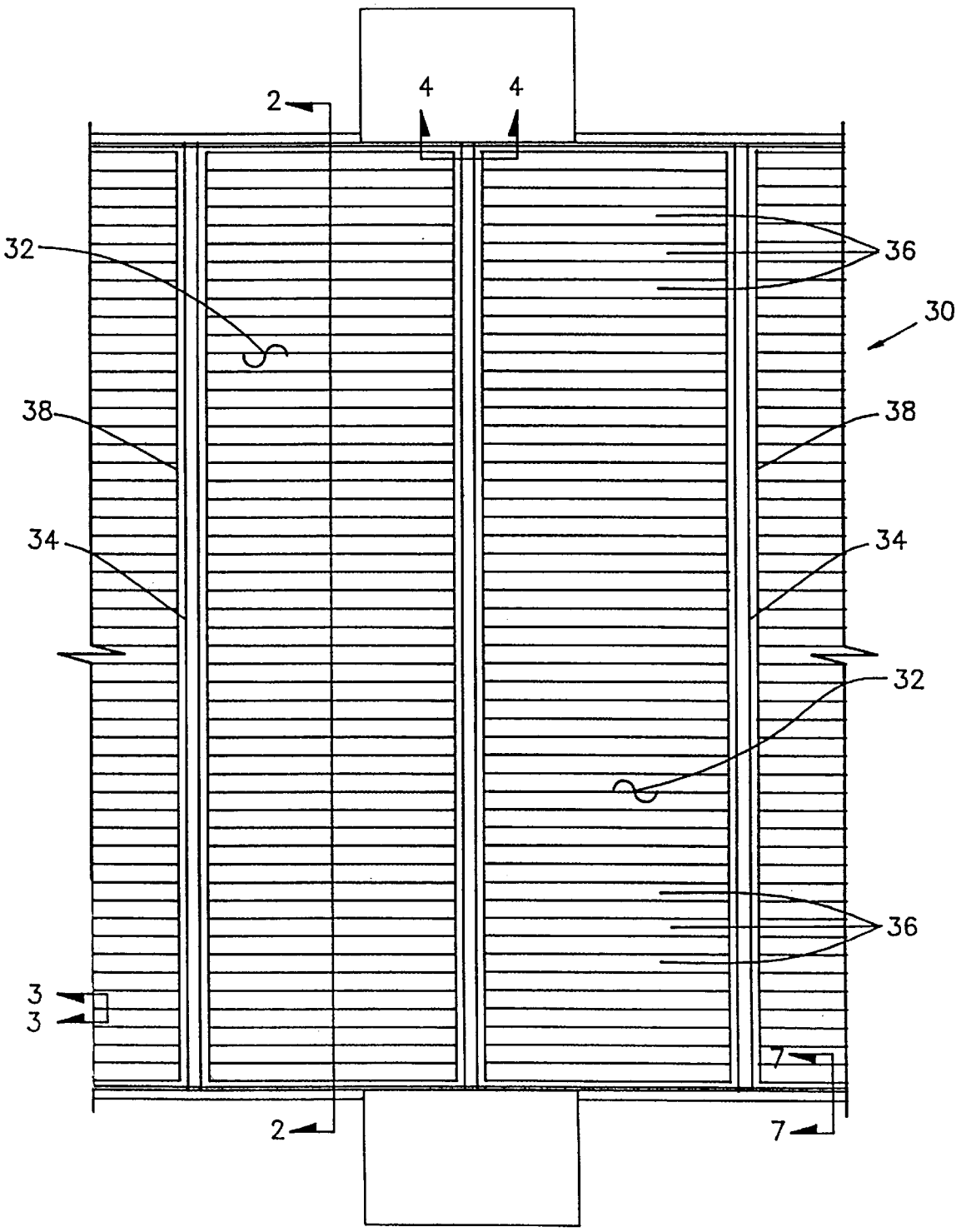
FIG. 1 schematically illustrates a fragmentary plan view of a rectangular cover in accordance with the present invention.

Turning now to the drawings, FIG. 1 shows a fragmentary plan view of a cover 30 in accordance with the principles of the present invention. The cover is generally rectangular and comprises a plurality of generally rectangular panels 32 arranged side-by-side to form the cover. Adjacent panels 32 are connected together by adjacent cross members 34. The panels are preferably connected to the cross members by a special form of sealable connection which is discussed in detail below.

Panels 32 are preferably constructed from a plurality of planks 36 arranged edge-to-edge and aligned along the length of the cover. Side members 38 are located along the edges of panels 32 extending across the width of all of the planks in the panel. Each of the side members 38 preferably includes means for receiving the ends of the planks, such that the planks may be supported by the side members solely at their ends. Side members 38 preferably also include interconnecting means for connecting them, and thus the panels, to cross members 34, in such a way that a connection between a panel and a cross member may be substantially gas-tight.

Transverse support members 34 are preferably preformed such that planks 36 are supported entirely at their ends by side members 38, which in turn are connected to cross members 34. The weight of an assembled cover is carried essentially entirely by the support members. Because of this, panels 32 are not required to contribute substantially to the rigidity of a cover structure and thus are not required to be rigidly constructed. Panels 32 may be constructed in such a way that they are substantially gas-tight, but may be sufficiently flexible that they are free to assume the form of a section of an arch or a dome. Arches and domes are preferred shapes for a cover. A further advantage of a flexible panel is that it is free to absorb changes in shape which may be imposed by environmental factors such as wind loads or thermal expansion.

Figure 2:
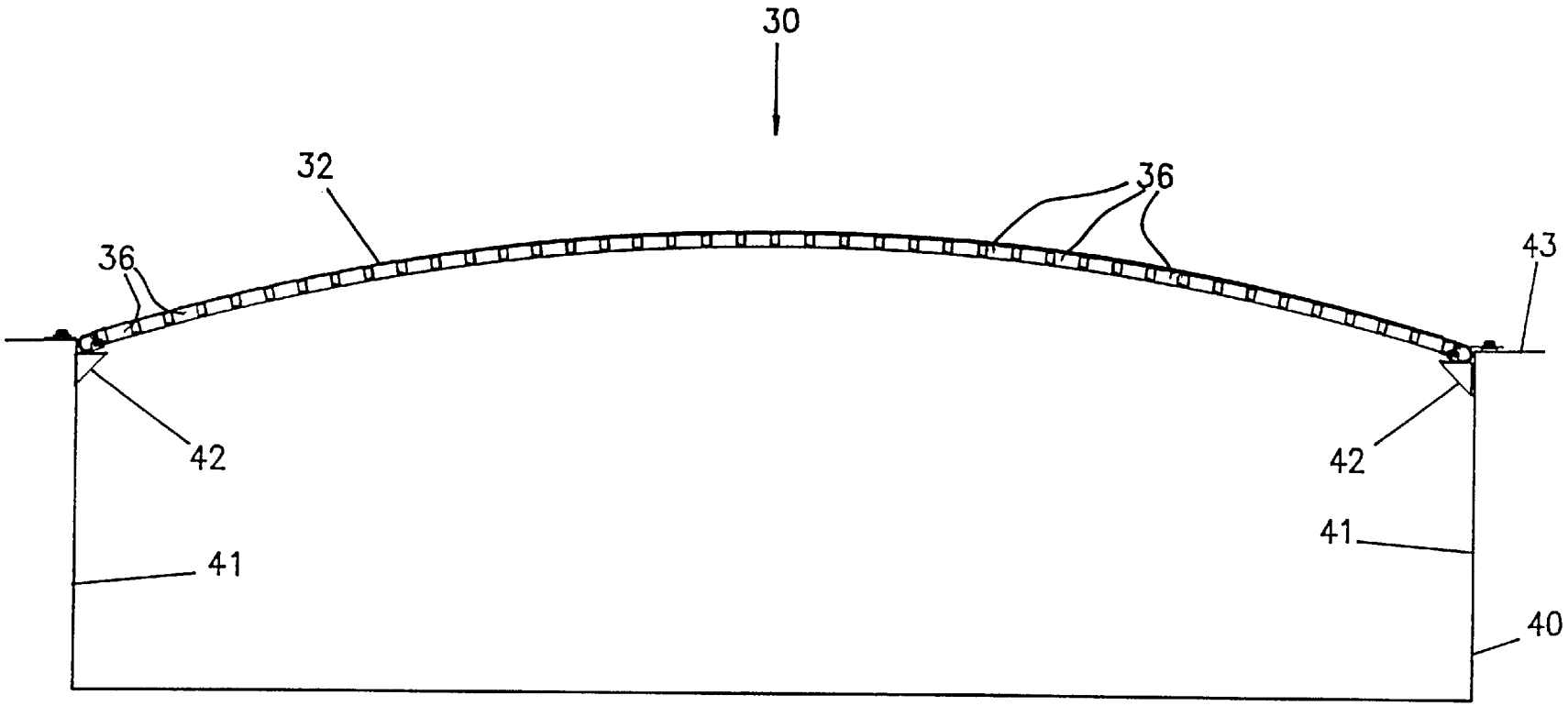
FIG. 2 is a cross-section view as seen generally in the direction 2—2 of FIG. 1.

In FIG. 2, the cover of FIG. 1 is shown in the form of an arch. It is shown in cross-section as seen generally along the line 2—2 of FIG. 1. The cover is supported on a tank 40 by a cover support arrangement 42 attached to the top thereof. An arch is an efficient structural form which allows a long distance to be spanned by a cover supported only at its extremities. An arch shape is preferably imparted to cover 30 by pre-forming cross members 34 and preferably side members 38 into an arcuate form. Planks 36 may be assembled into side members 38 to form semi-rigid panels 32 which assume the arch-like shape of the cover.

Figure 3A:
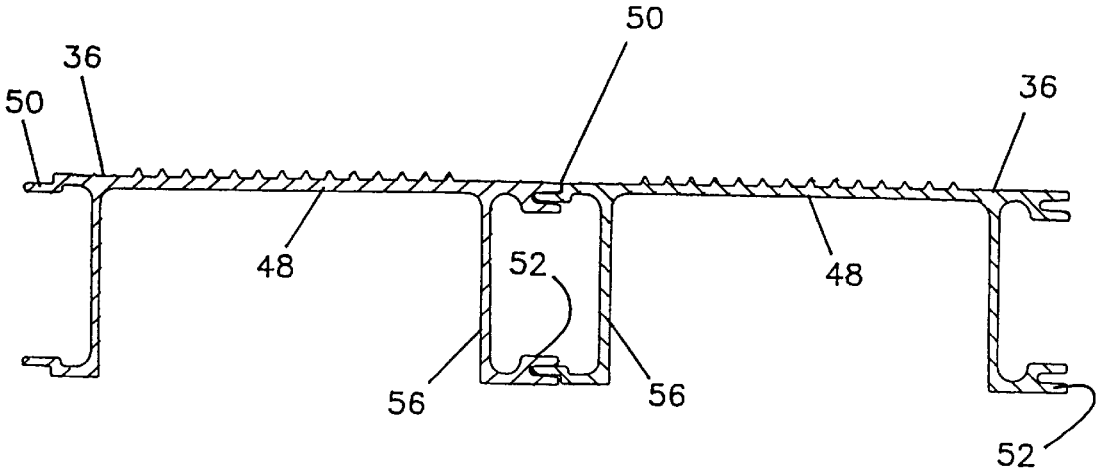
FIG. 3A schematically illustrates in cross-section a preferred form of planks for forming a cover in accordance with the present invention.
Figure 3B:
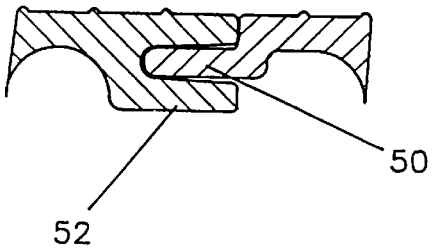
FIG. 3B schematically illustrates detail of a tongue-and-groove arrangement for interconnecting the planks of FIG. 3A.

Referring now to FIGS. 3A and 3B, details of a preferred form of planks 36 and a method of assembling them edge-to-edge is shown. Planks 36 are preferably formed from extruded aluminum and provided with a tongue-and-groove arrangement for connecting them together. Planks 36 include a flat, or deck portion 48 having along one edge thereof an outwardly extending protrusion or tongue 50 and along the other edge thereof an outwardly extending groove 52. Downwardly extending stiffening portions 56 impart a predetermined structural rigidity to the plank. The planks are assembled together edge-to-edge by inserting tongue 50 in groove 52 (see FIG. 3A), preferably without welds. Tongue 50 and groove 52 provide a firm, substantially gas-tight connection between planks 36, while providing a joint with sufficient flexibility that a multiplicity of the planks forming a panel is free to assume a slightly curved form.

It has been determined that a plank having a width of about four inches, and a depth of about two inches is convenient for forming covers having a span between about ten and fifty feet.

Figure 4A:
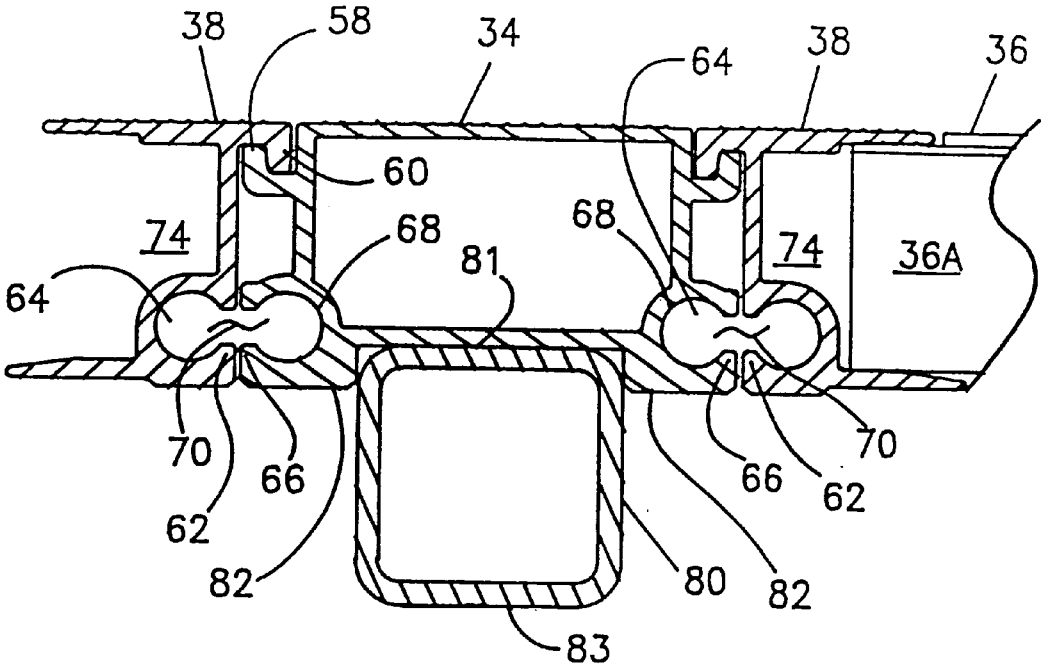
FIG. 4A is cross-section view seen generally in the direction 4—4 of FIG. 1 illustrating an interconnecting arrangement for panels and cross members of the cover of FIG. 1.
Figure 4B:
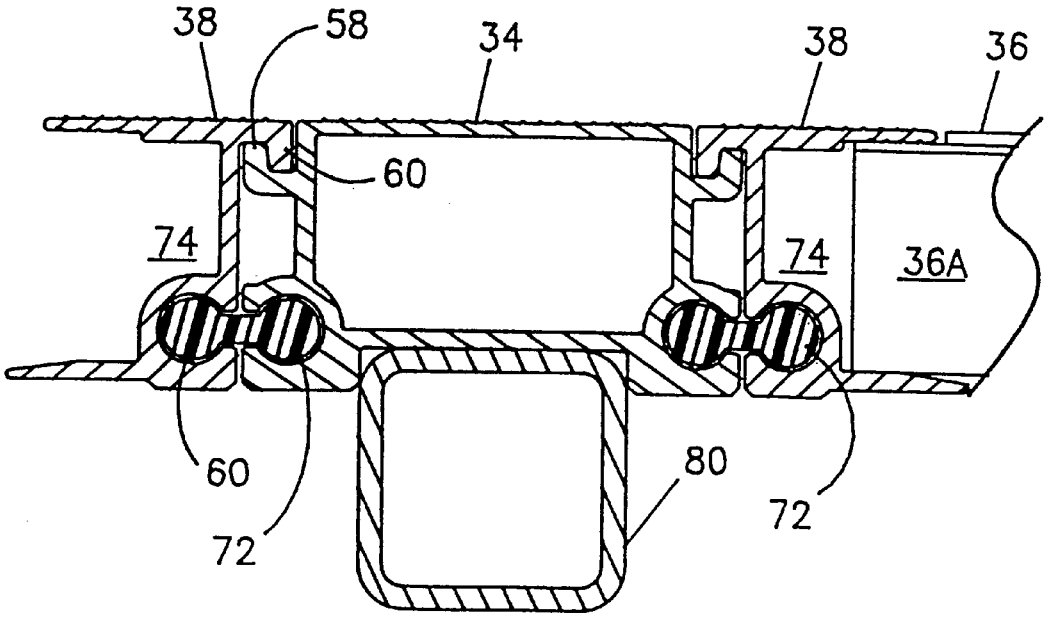
FIG. 4B shows the view of FIG. 4A including an interlocking seal strip for sealing a panel to a cross member.

In FIG. 4A and FIG. 4B is shown a cross-section view of a preferred form of cross members 34 and side members 38 as seen generally along the line 4—4 of FIG. 1. Here, transverse cross member 34, preferably formed from extruded aluminum, includes, on each side thereof, an outwardly and upwardly hooking flange 58. Side member 38 includes an outwardly and downwardly hooking flange 60. Flanges 58 and 60 are hooked together for connecting the side member, and thus panel 32, to cross member 34.

Below flange 60 on side member 38 is a slit 62 extending along the length of the side member. Slit 62 opens into a tunnel-shaped groove 64 also extending along the length of the side member. Similarly, cross member 34 has a slit 66 extending along the length of the support member below flange 58. Slit 66 opens into a tunnel-like groove 68 extending along the cross member. When flanges 58 and 60 are hooked together, slits 62 and 66 are substantially aligned with each other such that the slits and grooves together form an interlocking space.70, having a dumbbell or "dog-bone" type cross section.

An interlocking seal-strip 72 of a resilient plastic material such as ELVAX 670, available from DuPont of Wilmington, Del., and also having a dumbbell-shaped cross-section, is inserted into interlocking space 70, to form a substantially gas-tight seal between side member 38 and cross member 34. When seal-strip 72 is inserted unto space 70 (see FIG. 4B), it also prevents flanges 58 and 60 from being unhooked, and thus prevents side member 38 and thus panel 32 from being unintentionally disconnected from cross member 34. Panel 32 may, of course, be intentionally disconnected, for example, by withdrawing seal-strip 72 from interlocking space 70 and unhooking flanges 58 and 60.

It should be noted that while panel 32 and cross member 34 may be described as substantially locked together by seal-strip 72, some degree of relative movement of the side member on the cross member is possible. This allows the panels and support members to be configured into the curvature of a shallow-arch, as illustrated in FIG. 2, and, as will be discussed further below, into the shape of a dome.

Side member 38 includes a channel 74 for receiving the ends 36A of planks 36. Channel dimensions are selected such that a firm substantially gas-tight fit may be obtained between planks and side members, while allowing a sufficient degree of flexibility between them that a cover may conform to a shallow curvature.

As described above, planks 36 may be dimensioned such that one extrusion section is applicable to covers having different spans. Similarly it is preferable, to dimension side members 38 and cross members 34 such that they are usable in a wide range of cover sizes. This is not a problem for side members 38, as they are not required to bear a structural load and may be of only one form for a wide range of cover sizes. Cross members 34, however, are required to bear a structural load which increases as the size of a cover increases.

Continuing with reference to FIG. 4A, one means of standardizing a size for a cross members 34 is to dimension the member, such that, alone, it is adequate to support the smallest span envisaged, and, for larger spans, to provide the necessary rigidity by attaching a stiffening member 80 to surface 81 of cross member 34.

It has been found convenient for cross member 34 to have an overall width of about 3.5 inches and an overall depth of about 2.5 inches. As shown in FIG. 4A, stiffening member 80 may be of standard square section tubing about 1.75 inches in diameter. Stiffer stiffening members may be made, for example from larger section tubing attached to surfaces 82 of cross member 34, by attaching deeper section tubing to surface 81, or by adding additional tubing to surface 83 of stiffening member 80.

Figure 5:
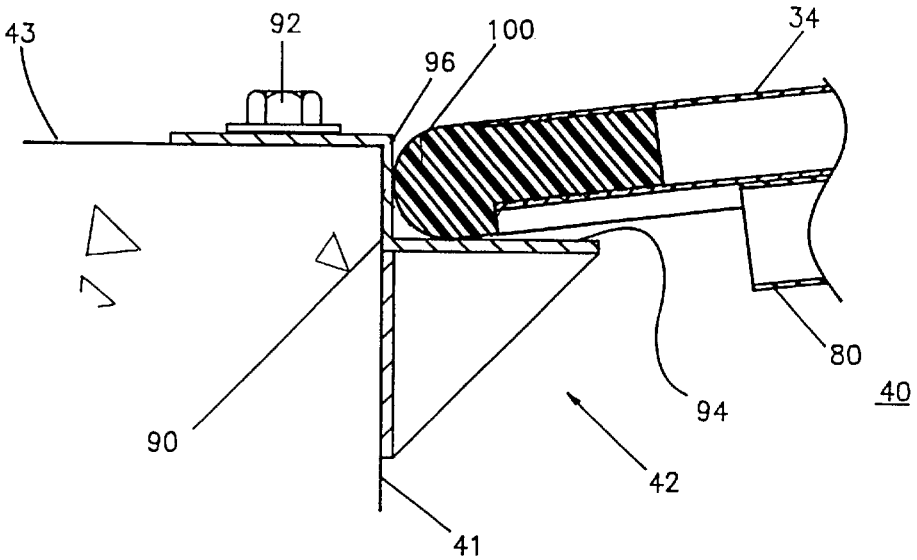
FIG. 5 is a cross-section view schematically illustrating one embodiment of a cover support arrangement for the cover of FIG. 1.

Continuing now with a description of a cover support arrangement for supporting cover 30 on a tank, FIG. 5 shows details of arrangement 42 (see also FIG. 2) for supporting the cover on an inside wall 41 of tank 40. The cover support arrangement 42 comprises a bracket 90 extending along the length of the tank and attached thereto at intervals by bolts 92. Although not shown in FIG. 5, it will be evident that at least two brackets 90 are required. One on each of two opposite sides of tank 40.

Bracket 90 includes a generally horizontal support member 94 for supporting the cross members and a vertical restraining member 96. Together, the vertical and horizontal members of bracket 90 form an inwardly facing L-shaped bracket for receiving cross members 34. Preferably the ends of cross members 34 include means for proving a slidable engagement with horizontal support member 94. This serves to permit movement of the cross members for accommodating changes in shape of cover 30 due to environmental and other loads. Preferably a seal is also provided between cross member 34 and support arrangement 42. In one embodiment, a slidable engagement and a seal may be provided by inserting in an end of a cross member a rounded block 100 of a resilient material such as DELRIN available from DuPont of Wilmington, Delaware. Such a material is sufficiently resilient and also has a sufficiently low coefficient of friction that it may slide on member 94 while still providing an effective seal at the point of contact. It should be noted that stiffening member 80 is terminated short of the end of cross member 34. By thus terminating stiffening member 80, or any other stiffening member or members, only one size of support arrangement is necessary to accommodate a variety of cover sizes.

Figure 6:
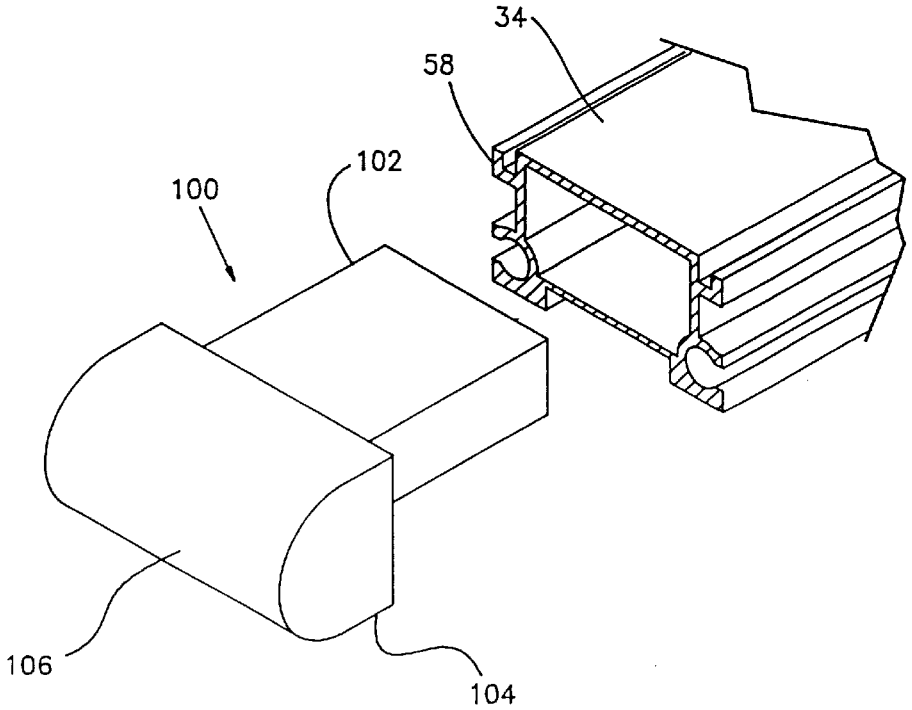
FIG. 6 is an exploded view schematically illustrating an end block for a cross member of the cover of FIG. 1.

In FIG. 6 is illustrated a preferred form of block 100. Here, block 100 includes a plug portion 102 having dimensions sufficient to provide a firm fit in an end of a cross member 34, and a contact portion 104 having a rectangular overall dimension, preferably sufficient completely cover an end of cross member 34. Contact portion 106 has a rounded surface 106 for providing slidable contact with horizontal support member 94.

Figure 7A:
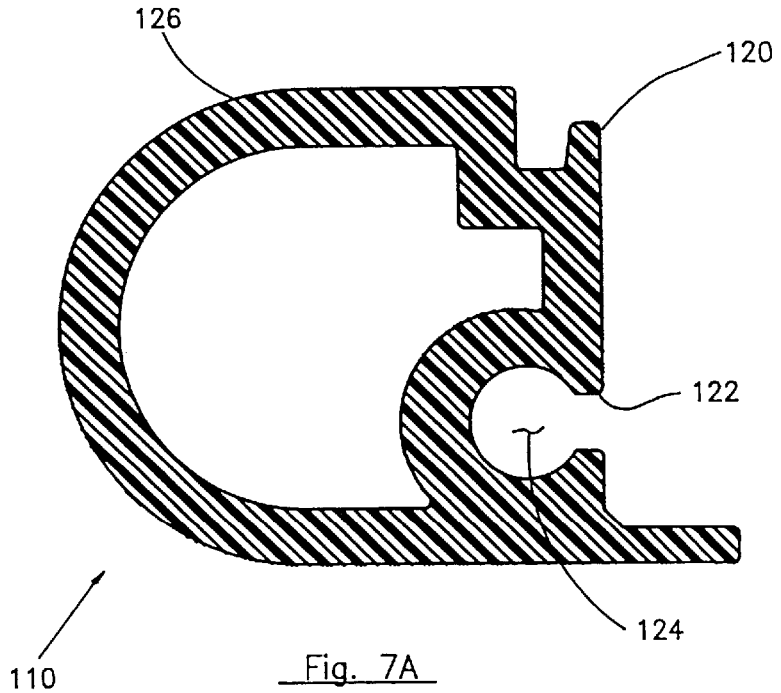
FIG. 7A is a general cross-section view of a sealing member for a panel of the cover of FIG. 1.
Figure 7B:
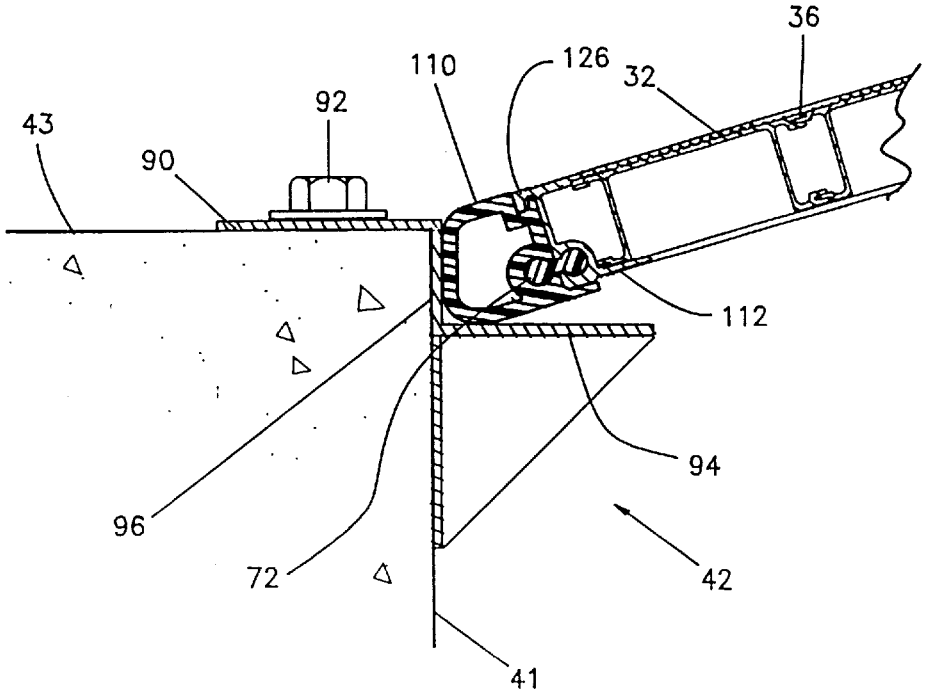
FIG. 7B is a cross-section view seen in the direction 7—7 of FIG. 1 schematically illustrating the sealing member of FIG. 7A attached to a panel in contact with the cover support arrangement of FIG. 5.

In FIGS. 7A and 7B is shown a method of sealing the ends of panels 32 with support arrangement 42. A sealing member 110 is illustrated in cross-section in FIG. 7A. The sealing member may be formed by a hollow extruded section of a plastic material such as RMPVC available from Fabricated Extrusions Company of Modesto, California. Sealing member 110 is configured to be attached to a boundary member, or terminating member, 112 (see FIG. 7B), which is attached to an end one of planks 36 in a panel 32. It includes an upwardly hooking flange 120 extending along the length of the member, and below the flange, a slit 122 opens into a tunnel-shaped groove 124. A rounded portion 126 is provided for forming a seal.

Continuing with reference to FIG. 7B, boundary member 112 is preferably made of the same extrusion as side members 38 of FIG. 4B), in the interest of reducing the number of different extrusions required to form a cover. The boundary member 112 thus includes an outwardly and downwardly hooking flange 126, and sealing member 110 is connected to boundary member 112 by hooking together flanges 120 and 126. Boundary member 112 also includes a slit which opens into a tunnel shaped groove (not identified by numerals but visible in FIG. 7B). The slit is aligned with slit 122 of sealing member 110, to provide a dumbbell shaped interlocking space (not visible in FIG. 7B but similar to interlocking space 70 of FIG. 4B). A sealing strip 72 inserted in the interlocking space provides a substantially gas-tight seal between boundary member 112 and sealing member 110 and prevents them from being unintentionally disconnected. When cover 30 is supported on horizontal support member 94 sealing member 110 is compressed against horizontal support member 94 of bracket 90 and vertical restraining member 96 (see FIG. 7B) to form a substantially gas-tight seal between a panel and the tank.

Figure 8:
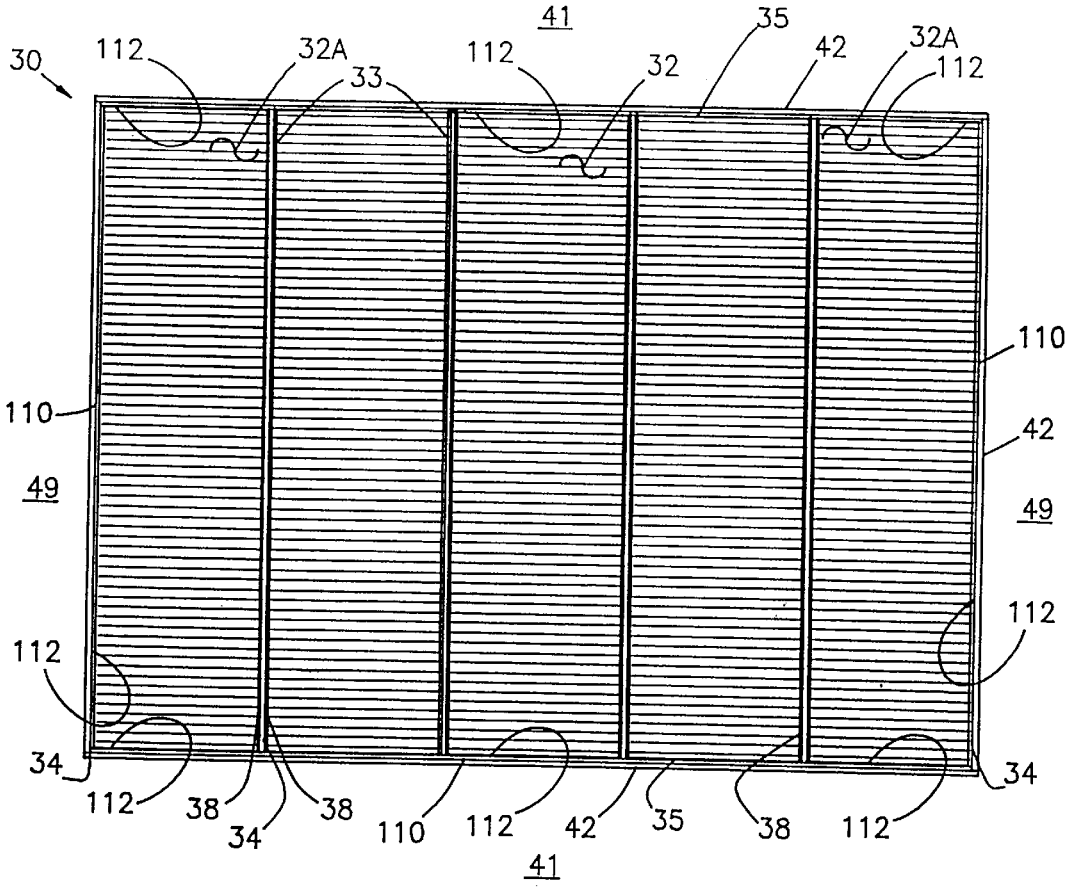
FIG. 8 is a plan view schematically illustrating the cover of FIG. 1 including two end panels.
Figure 9:
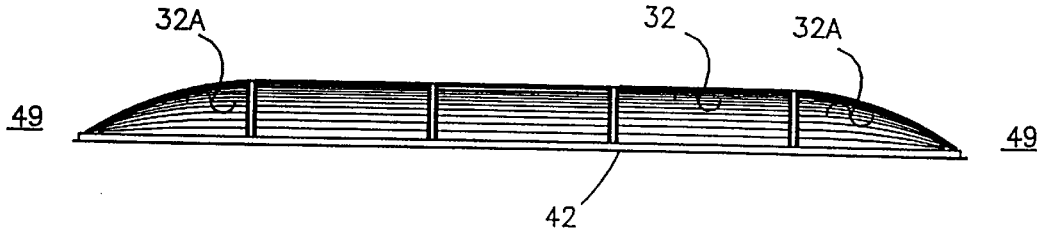
FIG. 9 is a side elevation view schematically illustrating curvature of the end panels of FIG. 8.

FIG. 8 and FIG. 9 show a method of completing the ends of rectangular cover 30. Here, cover 30 includes three panels 32, and two panels 32A which may be referred to as end panels. The cover has the shape of an arch having a rectangular periphery. All of the panels of the cover have a side member 38 attached to at least one of two generally parallel straight sides 33. In such an arrangement panels 32 would include a side member along each of generally parallel, straight sides 33, and a boundary member along each of ends 35, the side and boundary members attached to cross members and sealing members respectively, as described above. End panels 32A, have a side member 38 attached to only one of the straight sides and are attached to an end of one of cross members 34. On the opposite straight sides and on both ends of panels 32A is attached a boundary member 112 having a sealing member attached thereto as described above.

A rectangular tank to be covered may be provided with a cover support arrangement 42 as illustrated in FIG. 7B. The cover support arrangement is located along two opposite sides 41 of the tank, and with a similar arrangement along two opposite ends 49 of the tank, thus providing a generally rectangular cover support arrangement. Sealing members 110 on panels 32 and 32A, and end blocks 100 (see FIG. 5) on the ends of cross members 34, together form a substantially gas-tight seal between cover 30 and tank 40.

In FIG. 9 the height of cover 30 is exaggerated for purposes of illustration. In practice, an arched cover preferably has a ratio of width (span) to height at the vertex of about 20:1 or greater. Such a shallow arch provides minimum gas volume under the cover, consistent with still retaining an arch-like shape sufficient for structural efficiency. The curvature of end panels 32A, in practice, is thus significantly less than is illustrated in FIG. 9.

By way of example, an arch having a width or span of about seventeen feet may have a vertex height between about six and twelve inches. Because of this, and because of the freedom of compliance of planks and panels, pursuant to the above-described construction, end panels 32A may acquire a curved shape within the confines of a rectangular cover support and seal arrangement, without the need to pre-form planks into the curved shape.

Figure 10:
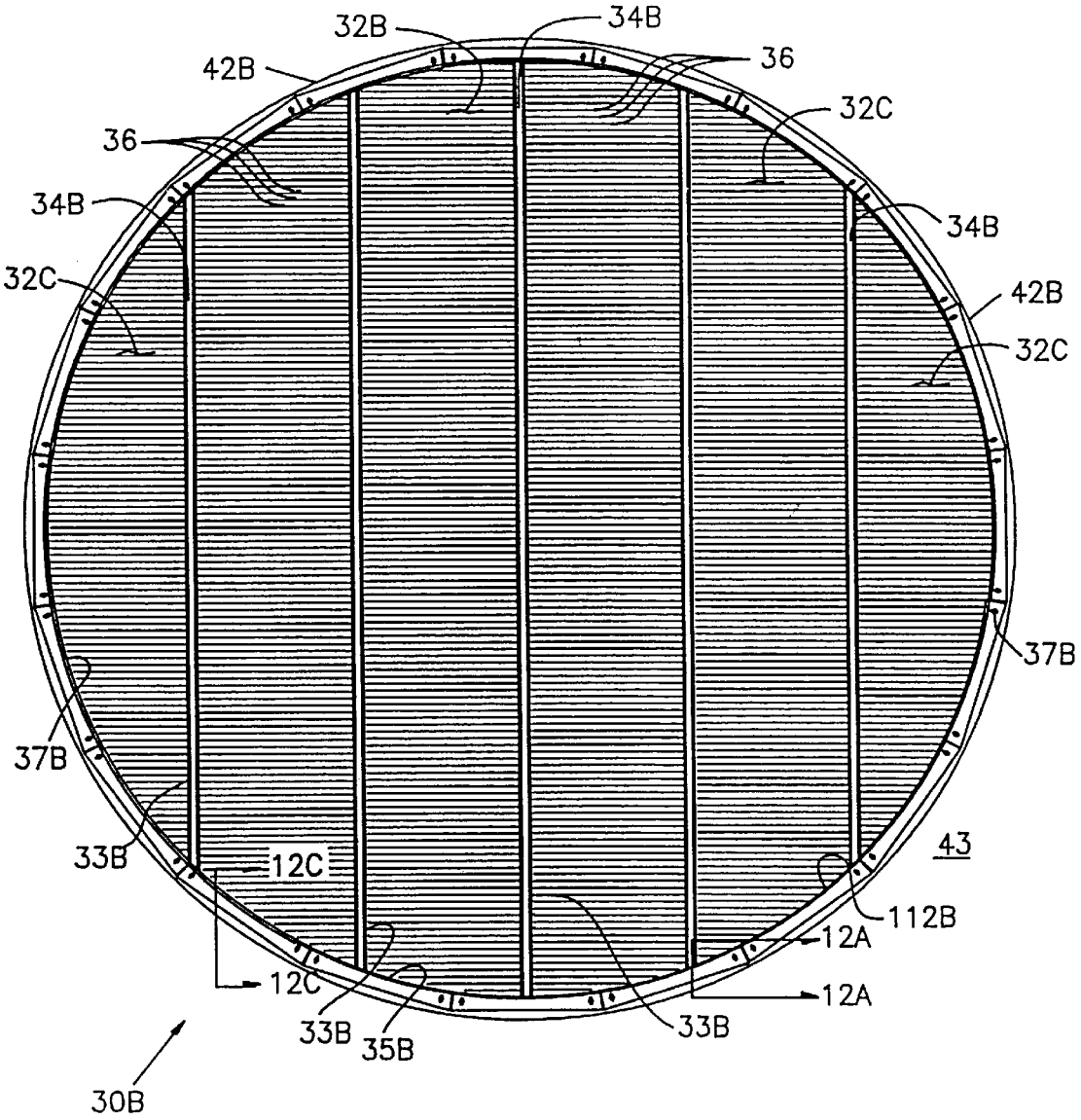
FIG. 10 is a plan view schematically illustrating a dome shaped cover in accordance with the present invention.
Figure 11:
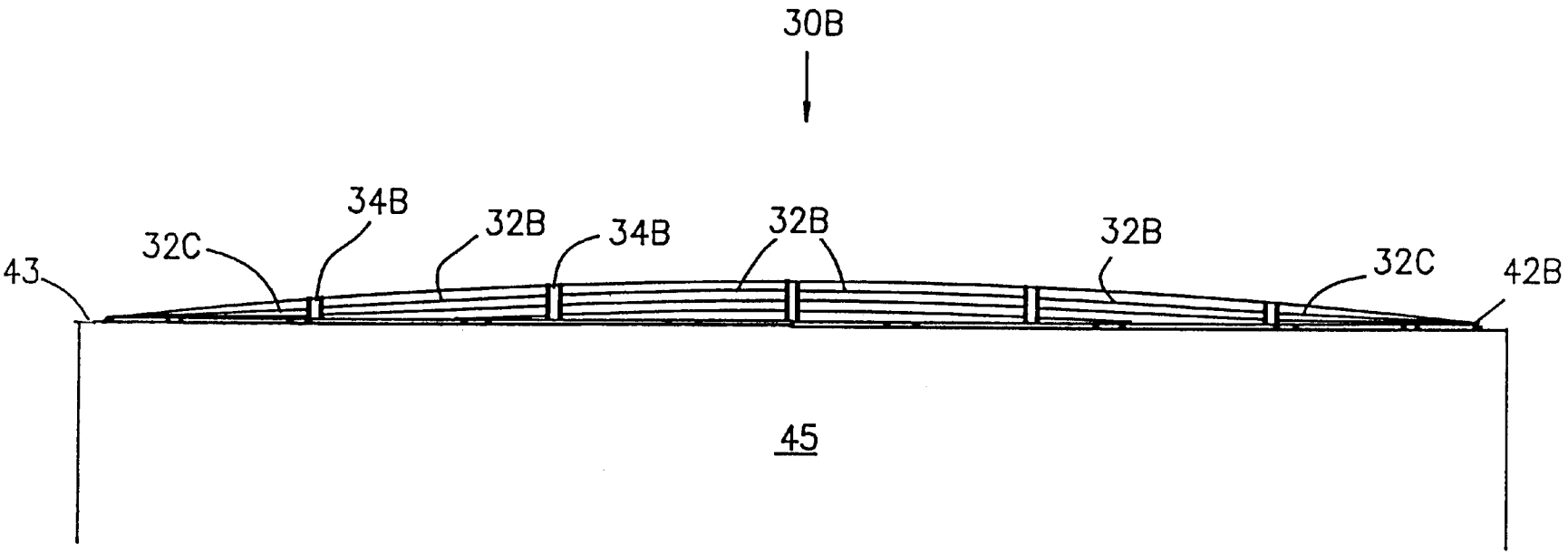
FIG. 11 is an elevation view of the cover of FIG. 10.

Continuing now with a description of preferred embodiments of the present invention, a cover 30B, having the form of a shallow dome, is illustrated in FIG. 10 and FIG. 11. Such a dome may have a diameter to height ratio of about 20:1 or less. Referring in particular to FIG. 10, such a dome may be constructed, from panels 32B and 32C each having the form of a section of a circle having about the same diameter as the dome. Panels 32B have two generally parallel straight sides 33B and two curved ends 35B. When the cover is assembled the covered ends of the panels lie generally on a circle having about the same diameter as the dome.

End panels 32C each include a straight side 33B and a curved side 37B, the ends of panels 32C being essentially pointed. Panels 32B and 32C are preferably constructed of edge-to-edge planks 36 as described above, and are arranged together side-by-side and connected together by cross members 34B. Panels 32C are each connected to an end one the cross members. Panels 32B have a side member 38 on each straight side and panels 32C have a side member on straight side 33B. Cross members 34B and side members connected thereto, are similar in construction to cross members 34 and side members 38 of rectangular cover 30 (see FIGS. 4A and 4B), with the exception that each has a particular arcuate form such that the arrangement of panels and cross members forms a cover having the shape of a dome.

End members 112B (attached to each of curved ends 35B and to curved sides 37C) have sealing members 110 attached thereto (not visible in FIG. 10). They are preferably arranged as illustrated in FIGS. 7A and B, with the exception that end members 112B are curved such that sealing members fall on a circle having about the same diameter as the diameter of the dome. The method of attaching and sealing panels 32B and 32C to cross members 34B is preferably as described above for panels 32 and cross members 34.

A preferred cover support and seal arrangement 42B for cover 30B is illustrated in FIGS. 12A, 12B, 12C, and 13. In arrangement 42B, a plate 150 is attached by one or more bolts 92 to the top 43 of a circular tank 45. Plate 150 provides a horizontal support member and an angle section 152 attached thereto forms a vertical restraining member 154. The plate and the angle section together define an inward facing circular U-shaped channel or bracket 158, encircling tank 45 for receiving cross members 34B. Cross member 34B includes an end block 100B for providing slidable engagement and a substantially gas-tight seal with channel 158. Block 100B is similar in construction to block 110 (see FIG. 6) with the exception that, as illustrated in plan view only in FIG. 12B, curved portion 106B thereof is preferably curved to conform to the curvature of channel 158.

Figure 12A:
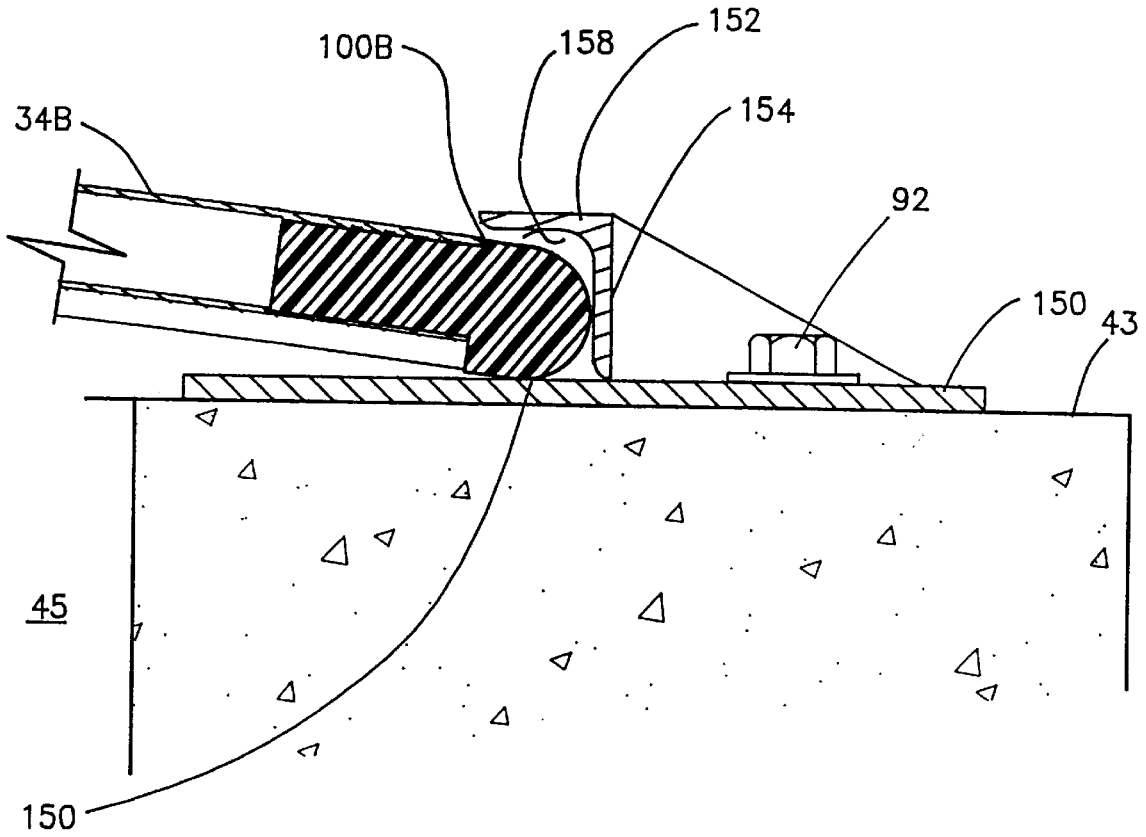
FIG. 12A is a cross section view seen generally in the direction 12A—12A of FIG. 10 schematically illustrating a cover support arrangement for the dome-shaped cover of FIG. 10.
Figure 12B:
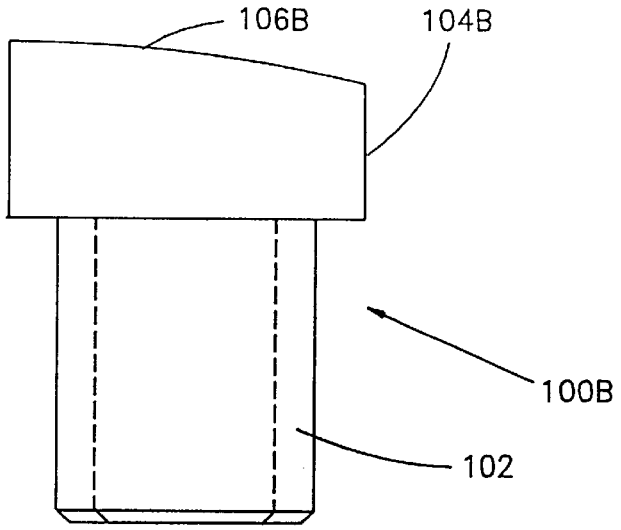
FIG. 12B is a plan view schematically illustrating an end block for a cross member of the cover of FIG. 10.
Figure 12C:
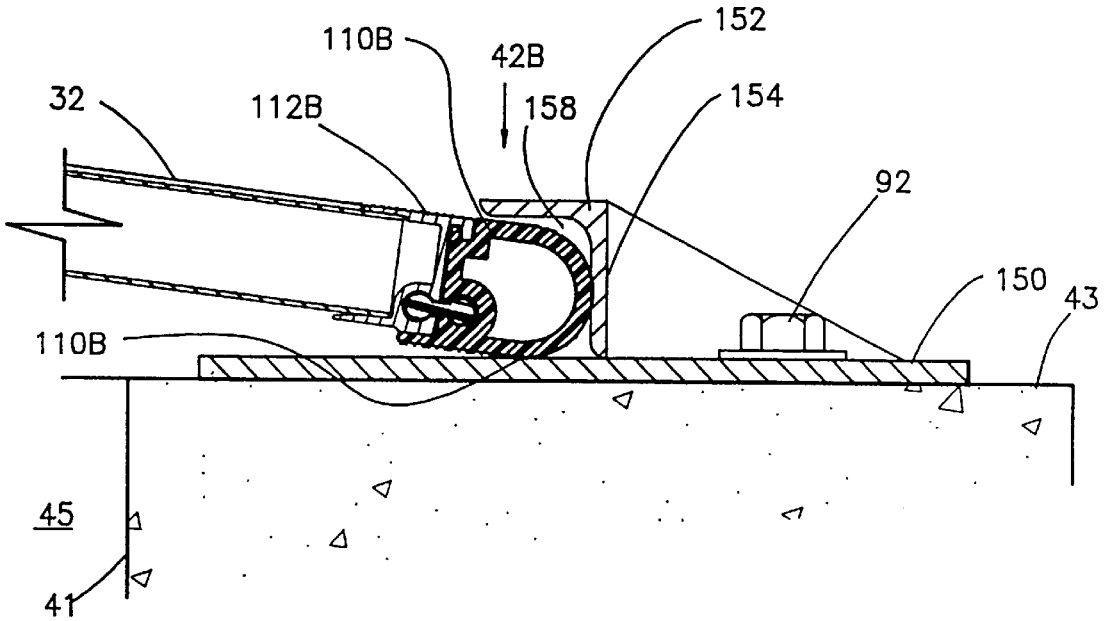
FIG. 12C is a cross-section view seen generally in the direction 12C—12C of FIG. 10 schematically illustrating a sealing arrangement for a panel of the cover of FIG. 10.

In FIG. 12C is shown the arrangement of a panel end member 112B and a sealing member 110B received by channel 158. The method of attaching an end member to a panel and a sealing member to an end member is similar to the method described above for rectangular cover 30.

Figure 13:
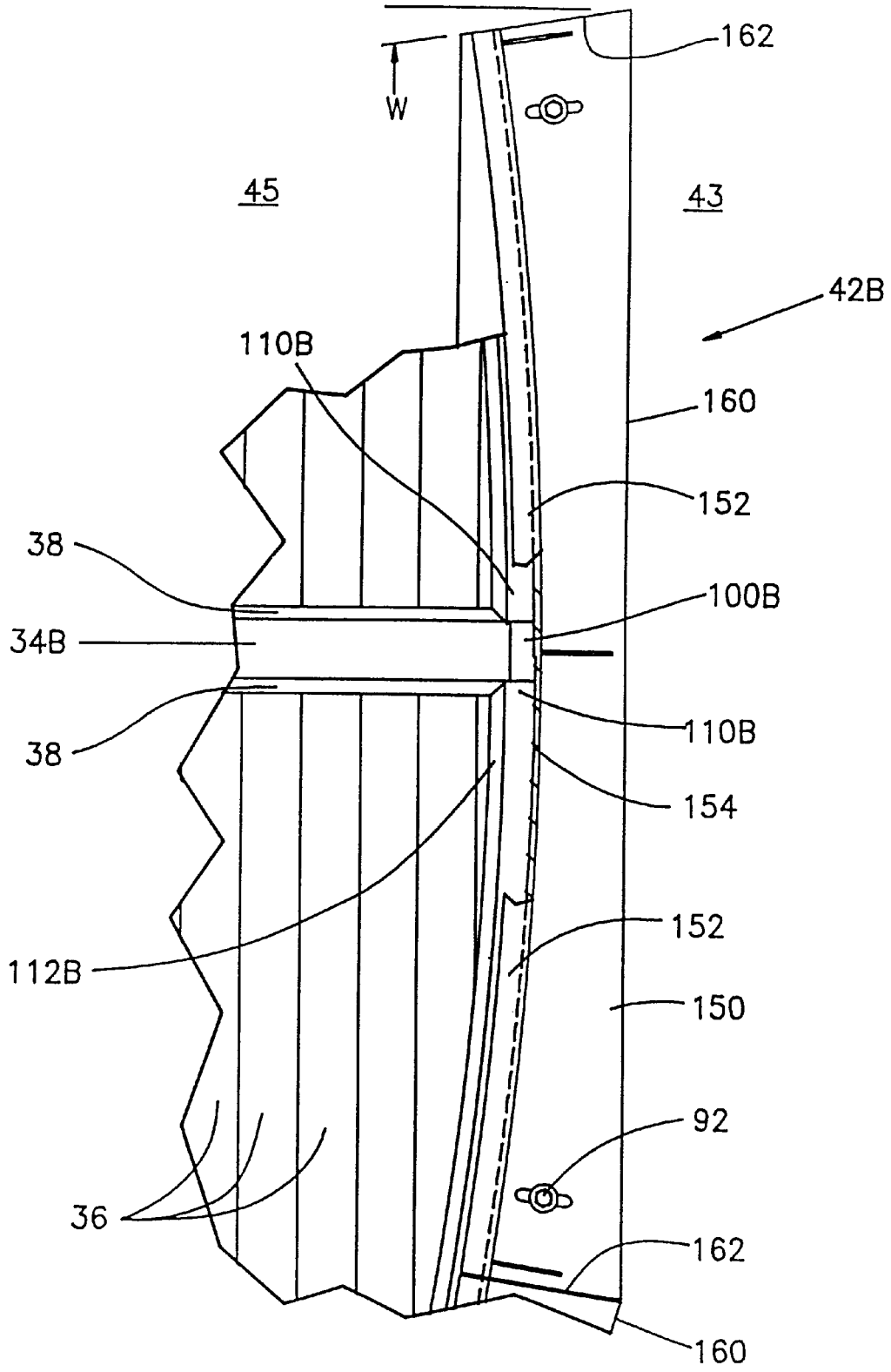
FIG. 13 is a fragmentary plan view schematically illustrating a portion of the cover support arrangement of FIG. 12A and the panel sealing arrangement of FIG. 12C.

It will be appreciated that constructing cover support arrangement 42B as a single circular component is somewhat impractical, particularly for a tank cover which has a diameter of about fifty feet. Accordingly, it is preferable that the cover support arrangement is assembled into a circular form on site from components. FIG. 13 illustrates one of twenty units 160 which may be assembled to form circular cover support arrangement 42B. Units 160 have ends 162 inclined at an angle W of about nine degrees from square. Angle section 152, in the form of a shallow arc, is shown cut away in a central portion to show the arrangement of sealing members 110B and end blocks 100B in inwardly facing U-shaped channel 158.

While the use of a circular inwardly facing U-shaped channel has been described as a means for supporting dome-shaped cover 30B, it will be evident that a straight form of such a channel, extending along at least two opposite sides of a rectangular tank, may be used for supporting a rectangular arch-shaped cover. Similarly, the inwardly facing L-shaped bracket of FIG. 7B may equally well be used to arranged in a circular form to support a dome-shaped cover.

Figure 14A:
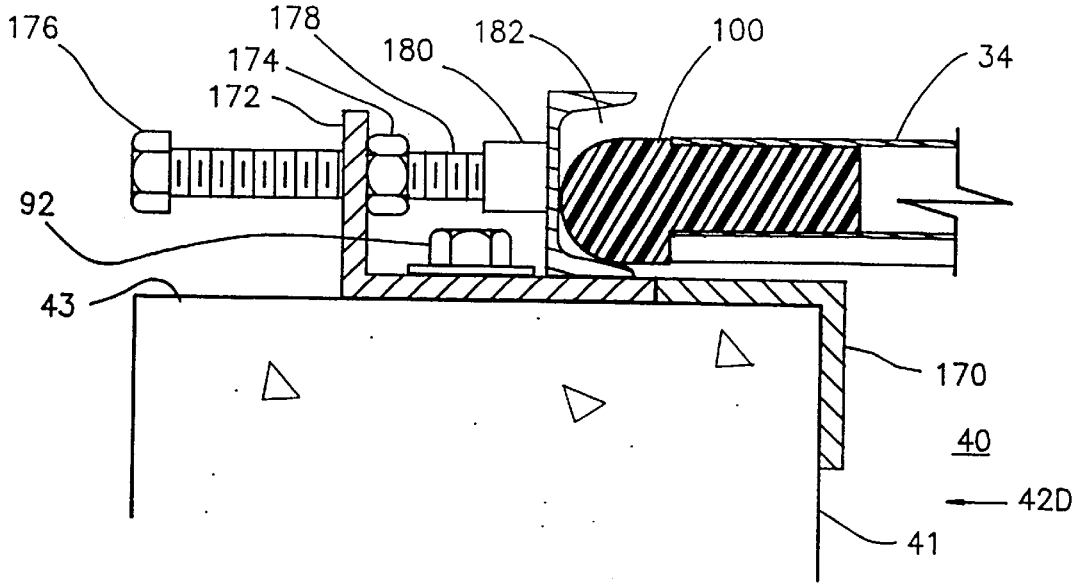
FIGS. 14A and 14B are cross section views schematically illustrating another embodiment of a cover support means for a rectangular cover according to the present invention.
Figure 14B:
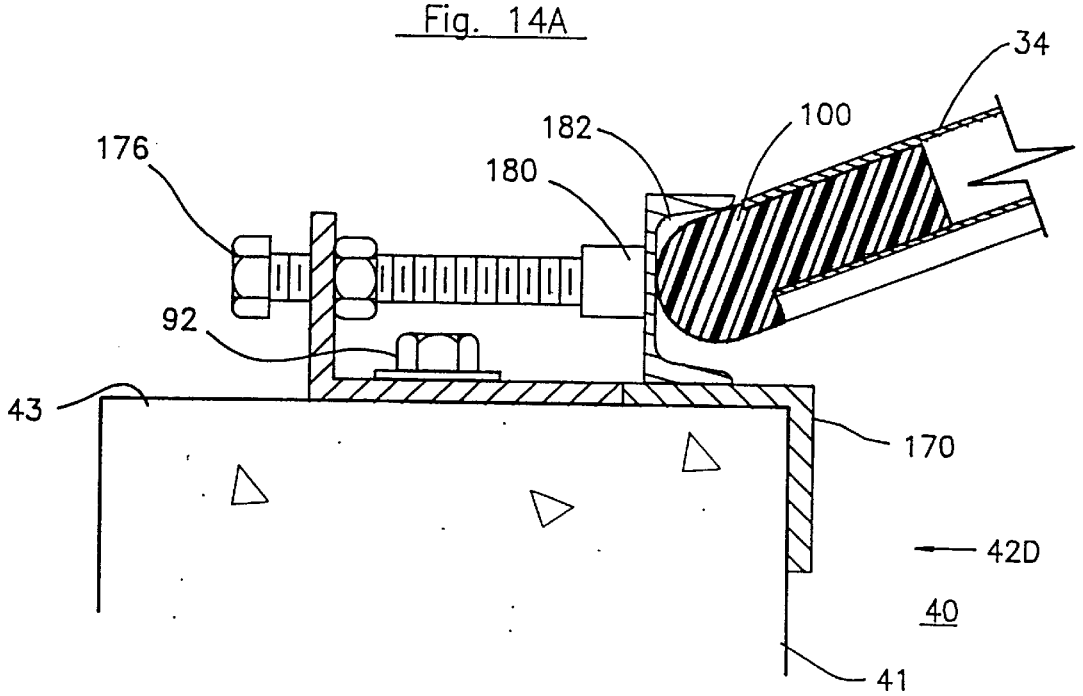

In FIGS. 14A and 14B, for example, is illustrated a particular form of cover support arrangement 42D which may be used to form an arch-shaped cover from an assembly of panels and cross members, wherein the cross members are, initially straight rather than pre-formed into an arcuate shape. In the arrangement of 42D, end block 100 of cross member 34 engages an inwardly facing U-shaped channel section 182. Channel 182 extends along the length of the tank for receiving cross members 34 and sealing members 110. Initially, cross member 34 is straight (see FIG. 14A). Channel 182 is free to slide on a bracket 170 which is attached by one or more bolts 92 to the top 43 of a rectangular tank. The bracket 170 includes a vertical member 172 having a nut 174 attached thereto. A bolt 176 has a threaded portion 178 extending through nut 174, and includes a bearing block 180 for engaging channel 182. Bolt 176 is one of a plurality of such bolts, preferably arranged for contacting the end of each cross member in a cover. A similar support arrangement (not shown) is located on an opposite side of the tank.

As bolts 176 are tightened, a compressive force is applied to each end of the cross members forcing the cross members to flex upward (see FIG. 14B) and assume an arcuate form. The cross members are preferably encouraged to flex in an upward direction, for example, by initially applying a lifting force with a crane or hoist attached at about the center of the cover. As already described, the assembly method for planks in the panels forming the cover, allows the panels to assume the same arcuate form as the cross members.

Continuing now with a discussion of dome shaped covers, a method of constructing a cover having a relatively deep domed shape will be described. Such a cover, for example, may have a ratio of height to diameter of about 5:1.

Figure 15:
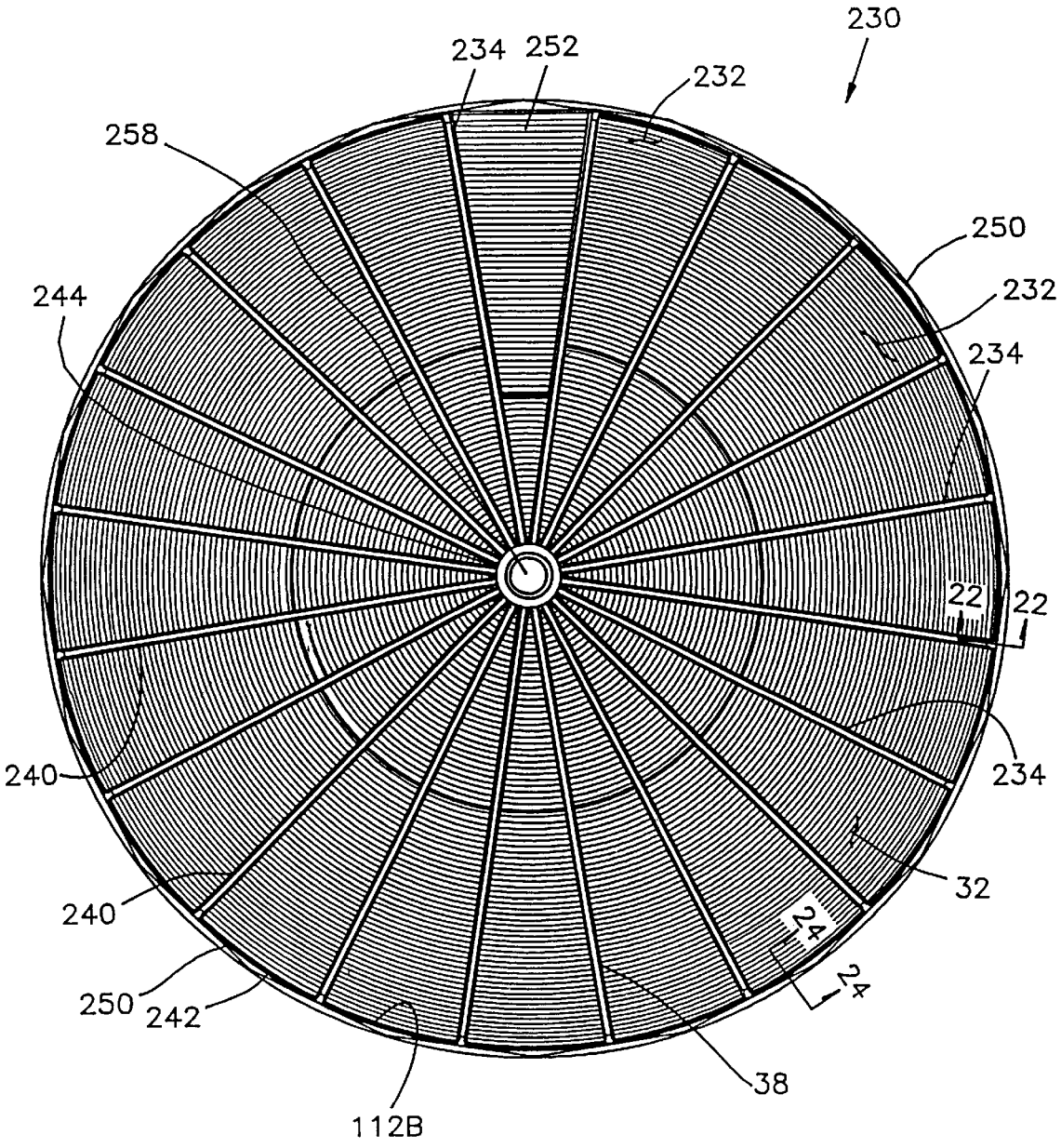
FIG. 15 is a plan view schematically illustrating another embodiment of a dome-shaped cover in accordance with the present invention.
Figure 16:
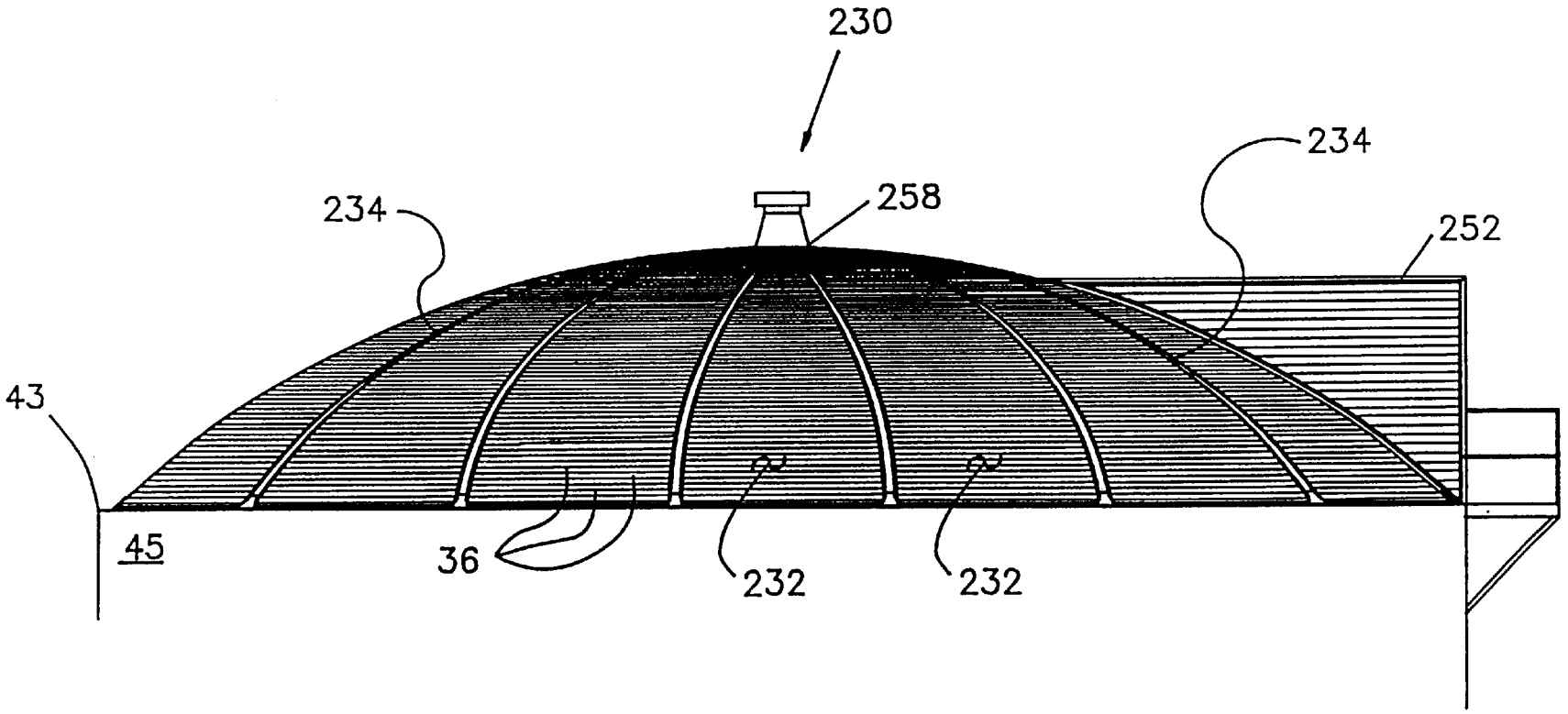
FIG. 16 is an elevation view schematically illustrating the dome-shaped cover of FIG. 15.

One preferred form of deep domed cover is illustrated in FIG. 15 and FIG. 16. Here, dome-shaped cover 230 includes a plurality of panels 232, each generally having the shape of a segment of a circle having about the same diameter as the dome, and a plurality of arcuate radial members 234. Panels 232 and radial members 234 are arranged alternately in a radial pattern (sse FIG. 15) with a panel located between each pair of adjacent radial members and attached thereto. A dormer or inspection hatch 252 may be provided in one of the panels, for example, for tank maintenance purposes.

Each panel 232 has two straight sides 240, a base 242 and an apex 244. The panels are preferably constructed of edge-to-edge planks 36 as described above for covers 30 and 30B. Panels 232 include a side member 38 on each of the straight sides and a boundary member 112B on the base and at the apex. Preferably, the radial members and side members are configured as described above (see FIGS. 4A and 4B) and have a similar interlocking and sealing arrangement, including a dumbbell-shaped interlocking and seal strip 72.

Continuing with reference to FIGS. 15 and 16, radial members 234 engage, at one end thereof, a compression unit 258, located at the center of the radial pattern of radial members and panels. At their other end, radial members 234 engage a cover support means or tension ring 250 attached to and encircling the top 43 of tank 45.

Figure 17A:
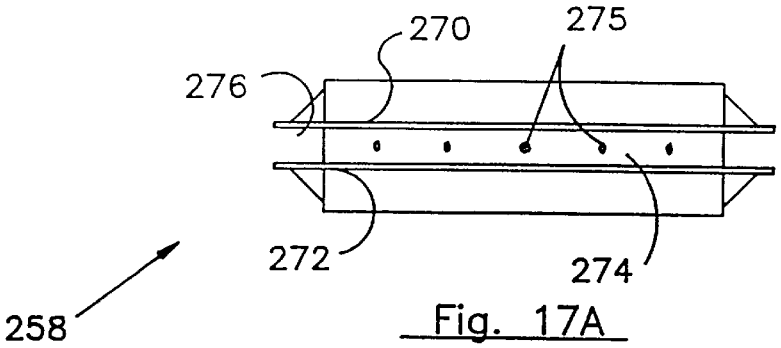
FIG. 17A is an elevation view schematically illustrating a compression unit for the dome-shaped cover of FIG. 15.
Figure 17B:
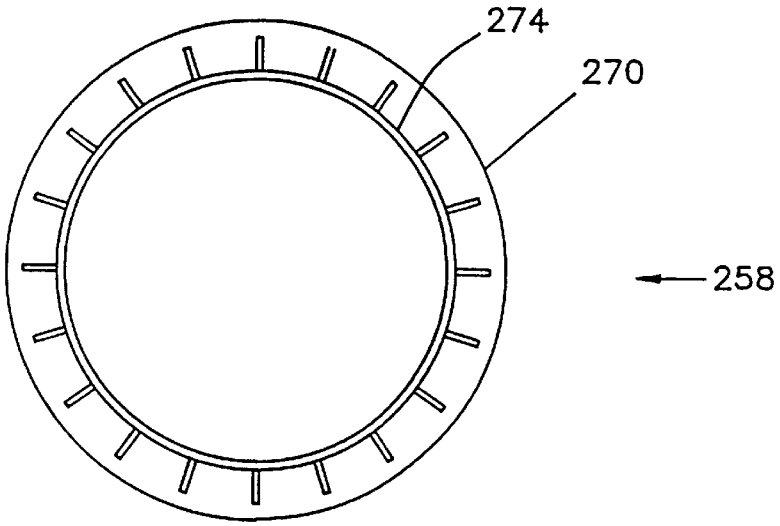
FIG. 17B is a plan view schematically illustrating the compression unit of FIG. 17A.
Figure 17C:
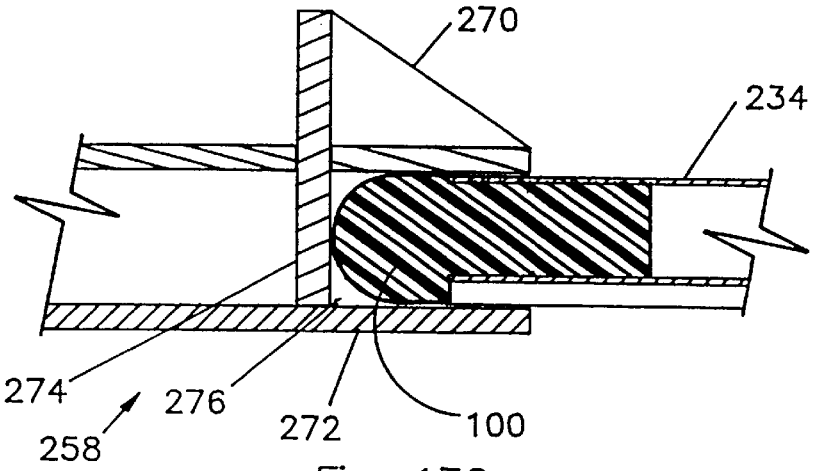
FIG. 17C is a cross-section view illustrating engagement of a radial member of the cover of FIG. 15 in the compression unit of FIG. 17A.
Figure 18:
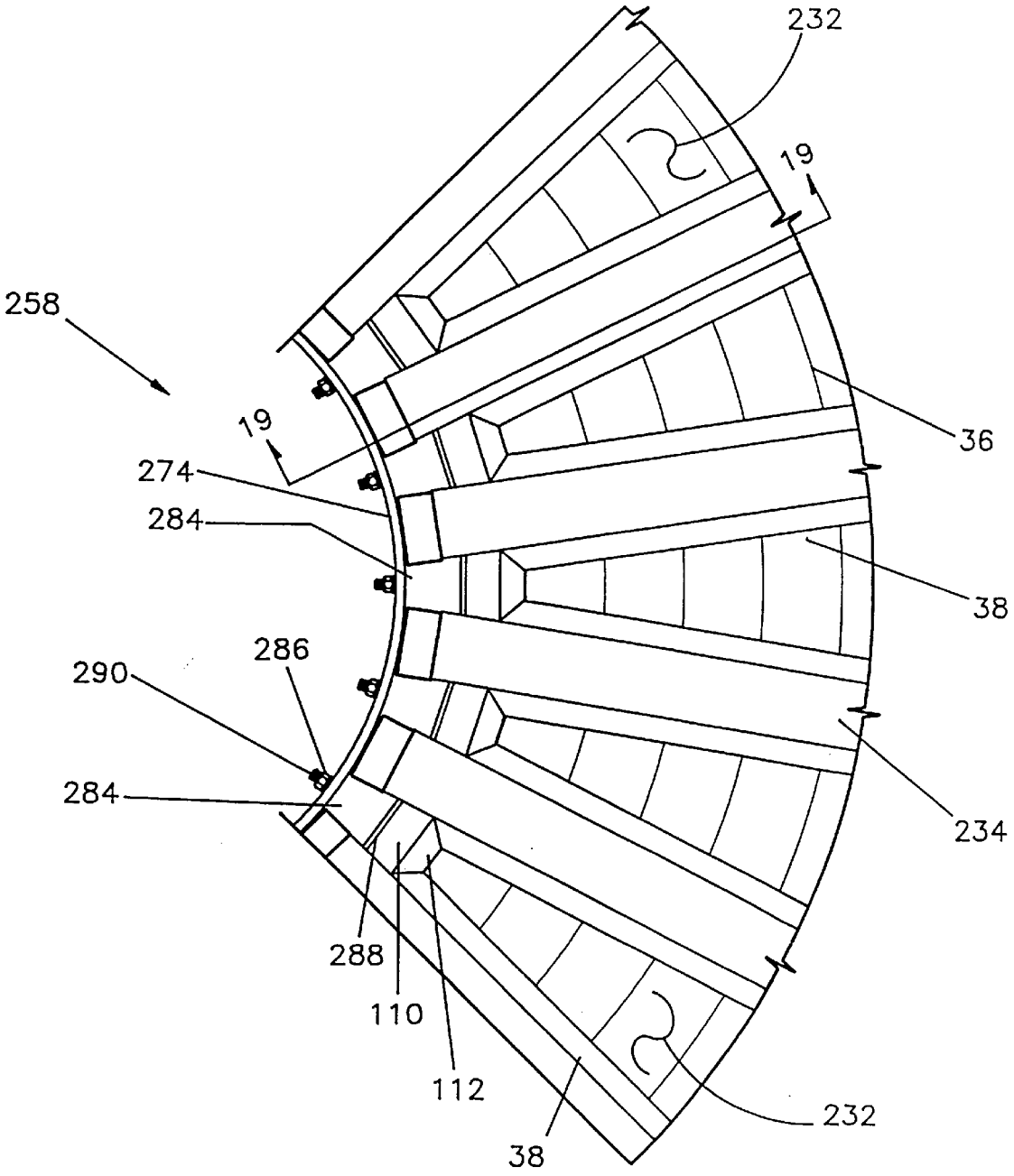
FIG. 18 is a fragmentary plan view schematically illustrating clamping arrangement for a radial member in a sealing arrangement for panels of the dome-shaped cover of FIG. 15.
Figure 19:
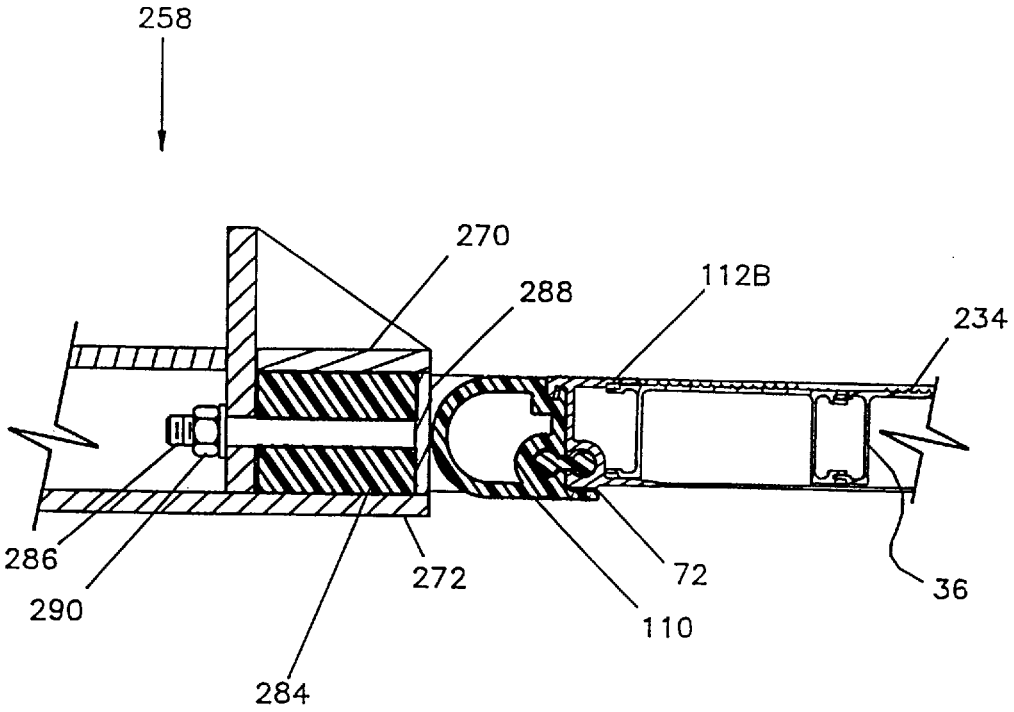
FIG. 19 is a cross section view seen generally in the direction 19—19 of FIG. 18, further illustrating a sealing arrangement for panels.

Referring now to FIGS. 17A, 17B, and 17C, one preferred form of compression unit 258 includes upper and lower annular portions 270 and 272 respectively, attached around a compression ring 274 to form an outward-facing channel 276 for receiving the ends of radial members 234. Referring now to FIG. 18, preferably, an end block 110, similar to the above-described end blocks for cross members 34 (see FIG. 6C) provides slidable engagement of a radial member 234 with channel 276 (see FIG. 17C), and provides a substantially gas-tight seal between the radial member and the compression ring.

Figure 21A:
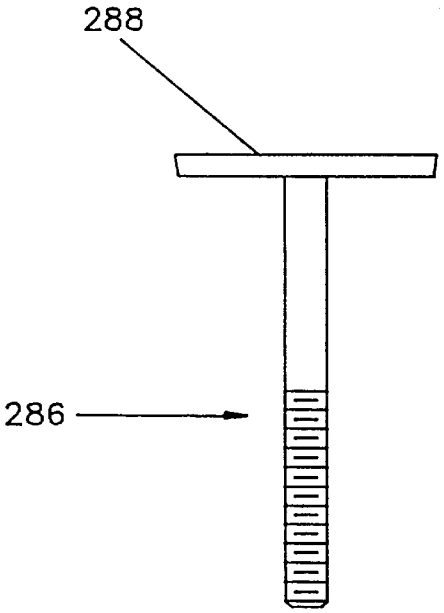
FIGS. 21A and 21B are elevation views schematically illustrating a bolt including a compression plate for the block of FIGS. 20A and 20B.
Figure 21B:
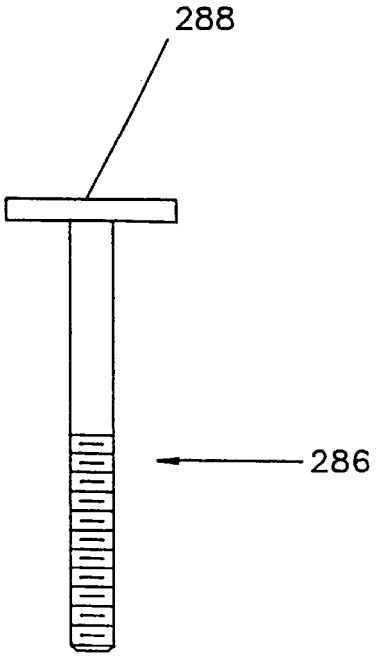

FIG. 18, FIG. 19, and FIGS. 20A and 20B show a method of clamping radial members 234 to compression unit 258. Between each pair of radial members 234 is located a clamping block 284 of a resilient material, preferably rubber. Clamping blocks 284 have a wedge shape including a narrow end 283 and a wide end 285 (see FIGS. 20A and 20B) and have a hole 287 through which is inserted a bolt 286. The block 284 is assembled on the compression ring with the narrow end against the compression ring. A threaded end of the bolt is passed through a hole 275 in compression ring 274 (see FIG. 17A) where it may be secured with a nut 290 inside of the ring (see FIG. 18). Referring to FIGS. 21A and 21B, bolt 286 has a head 288 in the form of a rectangular plate having about the same dimensions as wide end 285 of clamping block 284.

When a cover 230 is assembled, all of clamping blocks 284 are first assembled loosely on compression ring 274. Radial members 234 are placed in position between adjacent pairs of the blocks and the nuts 290 are loosely tightened.

After panels 232 have been attached to radial members 234, the nuts are progressively tightened, preferably all with about the same torque. Tightening the bolts compresses clamping blocks 284, and, clamps radial members 234 to compression unit 258, while at the same time effectively and automatically providing even spacing around the unit.

Figure 22:
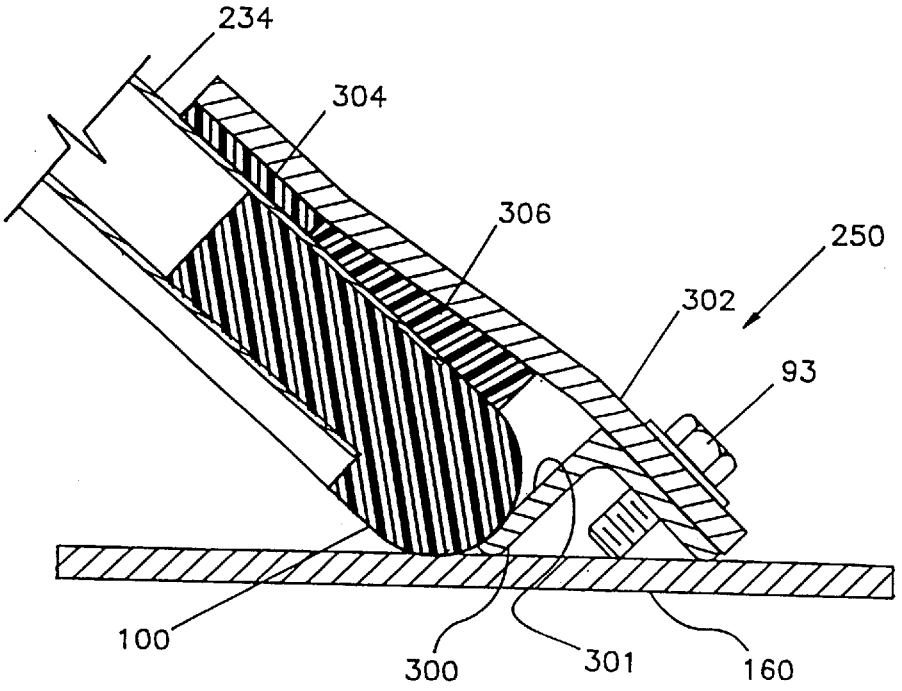
FIG. 22 is a cross section view seen generally in the direction 22—22 of FIG. 15 schematically illustrating details of a cover support arrangement for the dome shaped cover of FIG. 15.
Figure 20A:
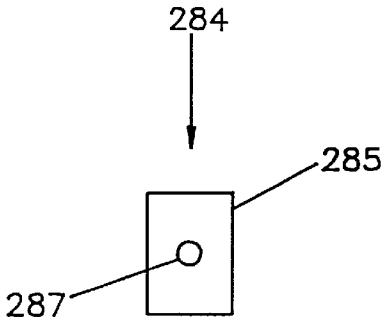
FIGS. 20A and 20B are plan and cross section views schematically illustrating a clamping block for the clamping arrangement of FIG. 18.
Figure 20B:
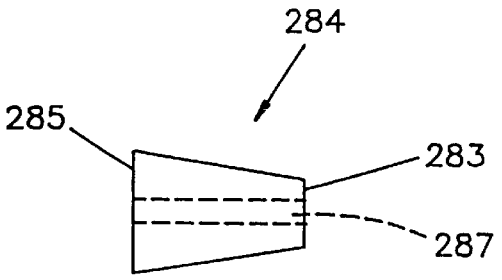
Figure 23:
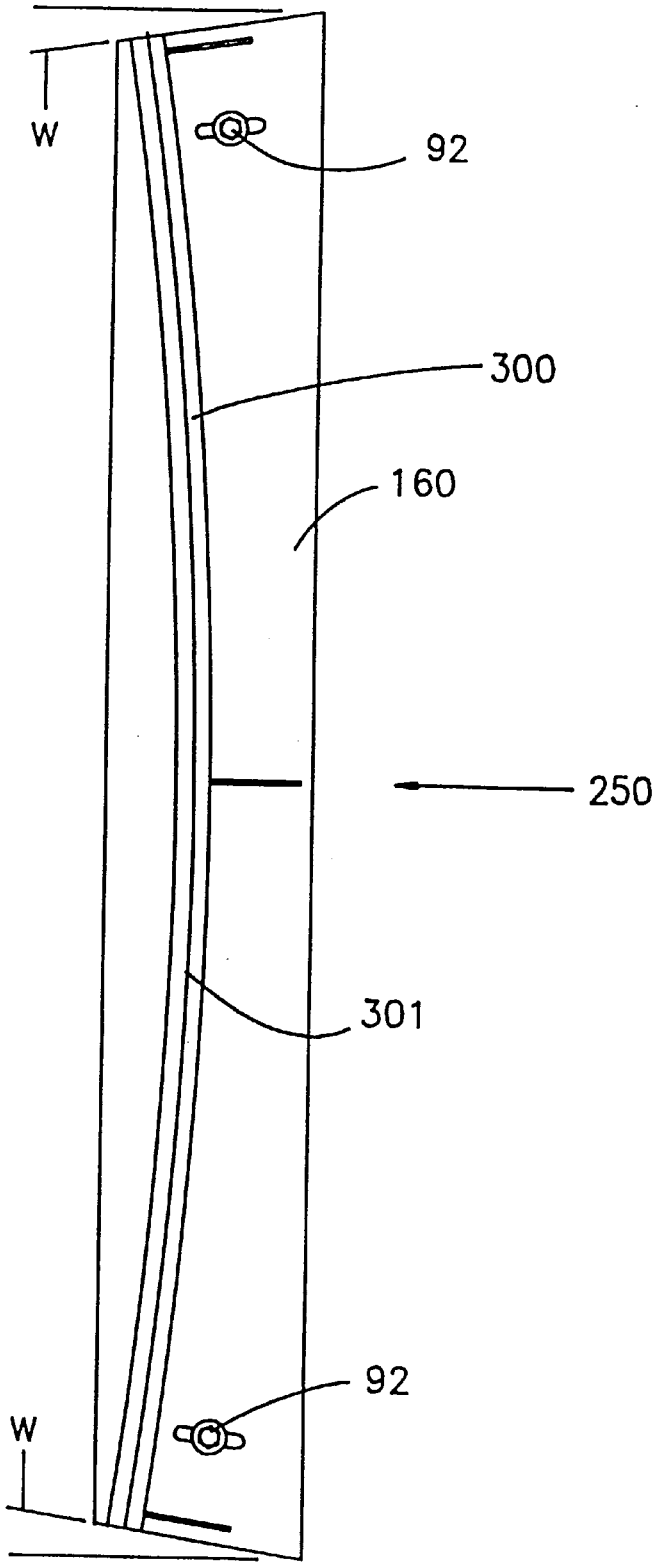
FIG. 23 is a plan view of a section of the cover support arrangement of FIG. 22.

A cover support arrangement 250 for cover 230 is illustrated in FIG. 22 and FIG. 23. An angle section 300 in the form of an arc of a circle is attached to each plate 160 of a series of such plates, attached to the top of the tank by bolts 92, to form cover support arrangement or tension ring 250. The angle sections 300 form a circular raised bearing surface 301 for receiving the ends of radial members 234. Adjacent the end of each radial member 234 a reinforcing plate 302 is attached to angle section 300, for example by a bolt 93. An end block 100 in the end of radial member 234 provides slidable engagement of the radial member with plate 160, and provides a substantially gas-tight seal between the radial member and the tension ring. A resilient rubbing strip 304 is preferably located between radial member 234 and reinforcing plate 302. Additionally, a flexible sealing material 306 may be located between plate 304 and radial member 234 for forming a secondary seal between the radial member and tension ring 250.

Figure 24:
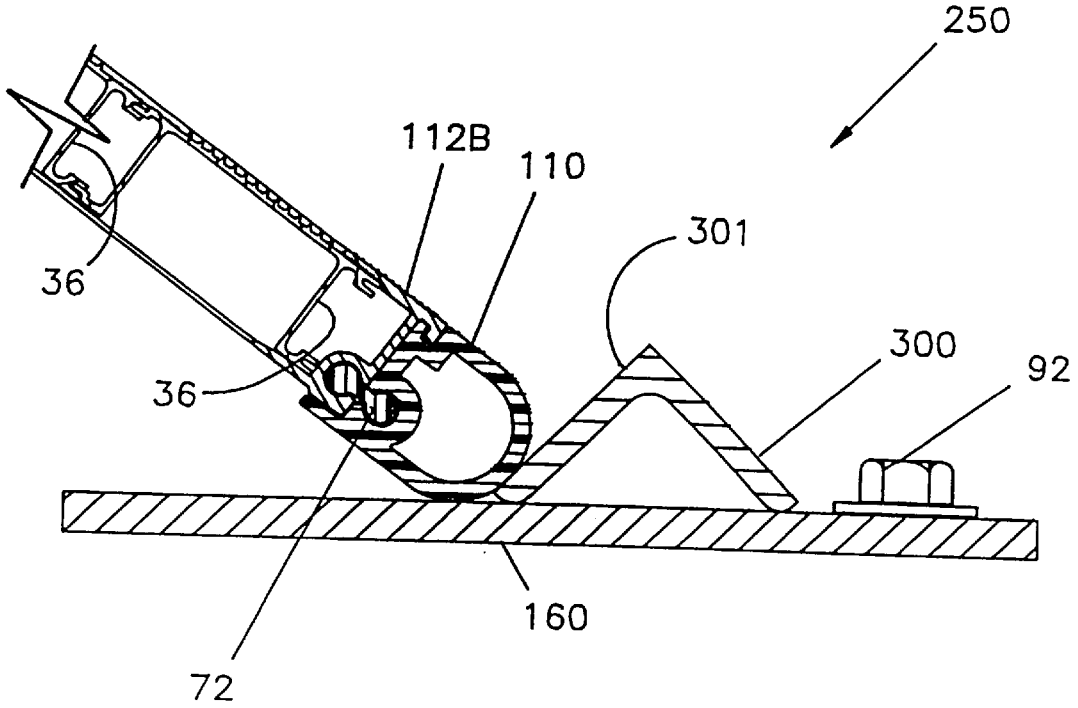
FIG. 24 is a cross section view seen generally in the direction 24—24 of FIG. 15 schematically illustrating a panel sealing method for the cover of FIG. 15.

To complete the description of cover 230, a method of sealing panels 232 to the tension ring and the compression unit is set forth. Referring again to FIGS. 18 and 19, and additionally to FIG. 4, panels 32 each preferably have a boundary member 112B attached to both the apex (see FIG. 19) and the base (see FIGS. 15 and 24) of the panels. Each boundary member has a sealing member 110 attached thereto, as described above for the panels of covers 30 and 30B. At the apex of a panel (see FIGS. 18 and 19), the sealing member engages plate 288 of bolt 286. At the base of a panel (see FIG. 24), the sealing member engages bearing surface 301 of tension ring 250. Together sealing members on panels 232, and end blocks 100 on radial members 234 effectively provide a cover which is substantially gas-tight.

The tank cover construction techniques described above may provide a substantially gas-tight seal for containment of all but a percentage of gas generally insufficient to provide objectionable odor in the vicinity of a tank. It is not represented, however, that such a cover is absolutely gas-tight for example as gas-tight as would be necessary to maintain a vacuum inside a tank. Clearly, the possibility of small amounts of leakage exists, for example at a junction of two seals, such as a junction between a sealing member 110 and an end block 100. One means of providing additional sealing or leakage control, for example, would be to spray a completed and assembled cover with a resilient sealing material such as PVC or with a rubberized paint. Such materials are well known to those familiar with the pertinent art.

Figure 25:
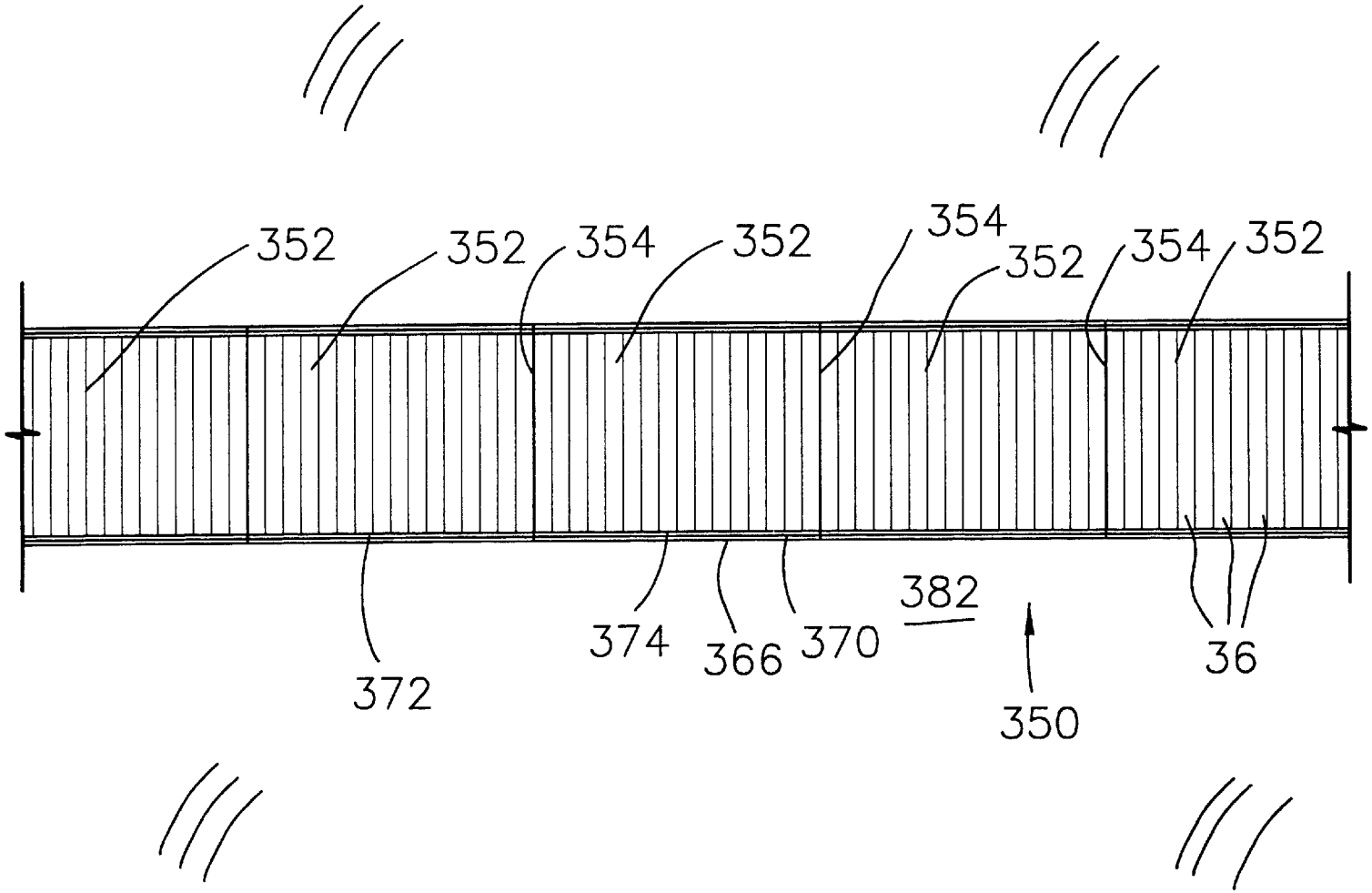
FIG. 25 is a plan view showing a tank or channel cover structure having planks extending across a single span, without multiple panels side-by-side.

FIG. 25 shows a tank or channel cover structure 350 made up of a series of panels 352 connected end-to-end, but without panels ganged side-by-side and thus with no structural members between them as is shown, for example, in the embodiment of FIG. 1. In this embodiment each panel is formed of a plurality of side-by-side, connected deck planks 36 which extend the entire width of the structure. As in the above embodiments, the panels 36 are interconnected side-by-side (as shown in FIG. 3A) by a tongue-in-groove type connection, with "male" tongue-in-groove connectors at one side of each plank and "female" tongue-in-groove connectors on the opposite side of each plank, all as shown in FIG. 3A.

Figure 26:
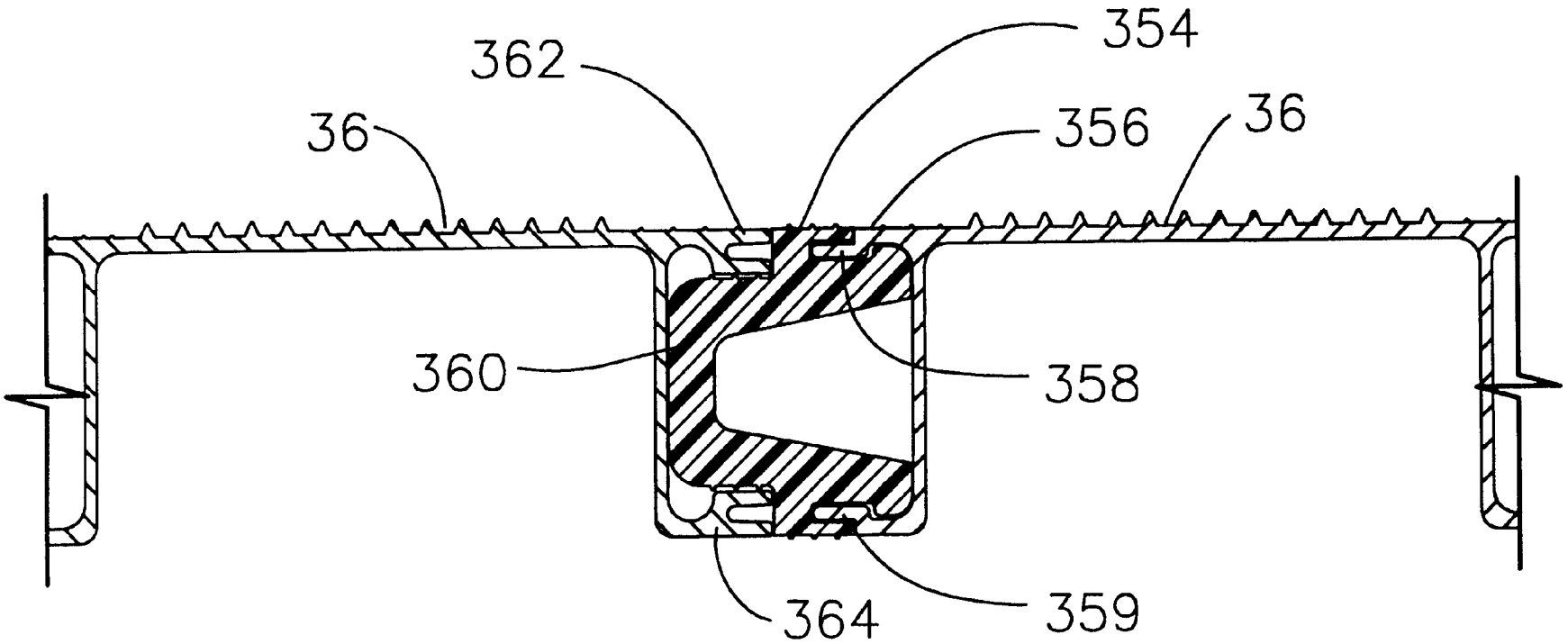
FIG. 26 is a detail view in elevational cross section, showing a pair of panels connected together by a flexible interlocking panel splice extrusion engaged with adjacent planks of the two adjacent panels.

In this embodiment the panels are secured as a series of end-to-end panels, making a channel or tank cover which can be of indeterminate length, but of a width which can essentially be spanned by the planks 36. Thus, the planks serve as essentially the only structural members of the assembly, in the sense of spanning across the width of the channel. At each joint between adjacent panels 352 is an interlocking panel splice strip 354, a rubber-like, flexible plastic extrusion shown in FIG. 26. The panel splice strip 354 is an extrusion configured to engage directly with the "male" side 356 of a deck plank 36, with extruded pockets as indicated for engaging over flanges 358 and 359 at the side 356 of the plank. At the opposite side of the extrusion 354 is a bullnose protrusion 360 which engages in a channel formed between "female" end flanges 362 and 364 which, as can be envisioned from FIG. 29 and as shown in earlier figures, normally receive the flanges 358, 359 of the adjacent plank when the planks are directly assembled together in a panel. These interlocking panel splice strips 354 may be formed of the material ELVAX manufactured by DuPont, comprising the material ethyl vinyl acetate, and they have sufficient structural strength in shear to interlock the planks of adjacent panels together, similar to the shear strength of adjacent interlocked planks within the panel itself. The extrusion 354 is simply pushed and snapped onto the "male" side of the plank 36, and when the next adjacent panel is assembled, the end is slipped over the bullnose 360 of the extrusion. In addition to the structural function, the panel splice strip 354 provides a substantially gas-tight seal for those applications wherein gases must be sealed within a tank.

Figure 27:
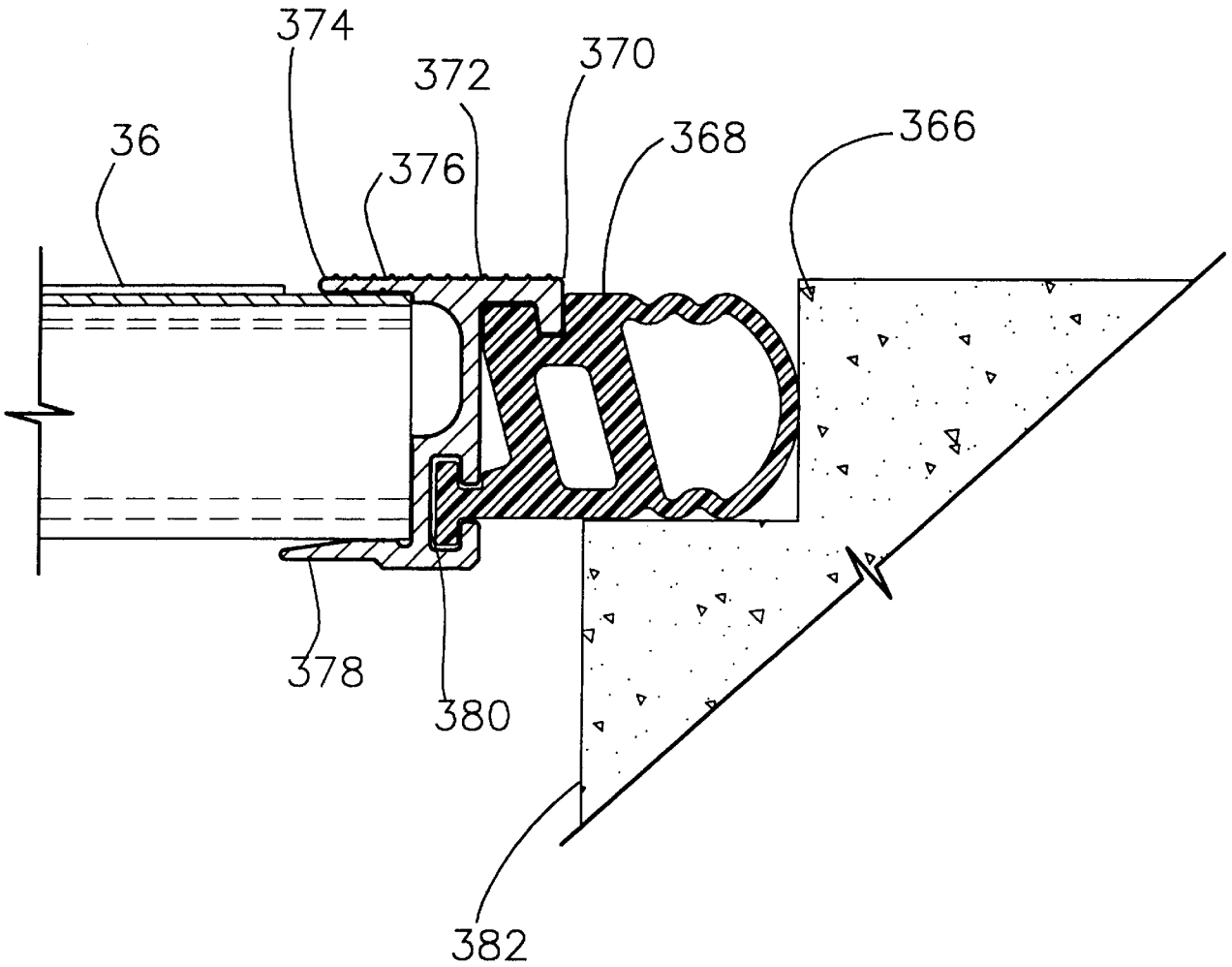
FIG. 27 is another detail view in elevational cross section, showing a cover structure at one edge, where the structure bears on a lip or edge of the tank or other open-topped structure.

Again referring to FIG. 25, at each of the side edges of the panels 352 are three lines, the first line 366 being the edge of a sealing strip or the coincident edge of the tank or channel rim or edge 382. This is shown also in greater detail in FIG. 27, which shows a particular load-bearing extruded seal 368 and, this material is advantageously the material Santoprene, also manufactured by DuPont. The next adjacent edge line 370 seen in FIG. 25 is the edge of a side member 372 as shown in FIG. 27, this side member being a modified version of the side members 38 shown in FIGS. 4A and 4B, for example. The inner line 374 in the group of edge lines in FIG. 25 is the inner edge of the side member 372 as seen in FIG. 27.

The edge seal 368, also serving as a structural supporting member for the deck assembly, is configured to slide together with the outer side of the side member 372 as show n in FIG. 27. The side member 372 is similar to the side members 38 described above and shown in other drawings, especially in receiving the ends of deck planks 36, between upper and lower flanges 376 and 378. The principal difference is in the generally keyhole shaped opening 380 at the lower, outer side of this member, which is shaped essentially rectangularly.

The rubber-like seal and structural strip 368 is formed so as to have sufficient structural capacity, in compression and shear, so as to hold the weight of the deck along the tank edge or rim, including live load. This is true even though, in the preferred arrangement shown, the outer dimension of the side member 372, i.e. the edge line 370, does not extend to the innermost edge 382 of the channel rim or edge. Thus, the entire assembled metal portion of the deck or cover in this arrangement is of lesser width than the span between the opposed edges 382 of the tank or channel. The strength of the rubber-like member 368 thus effectively acts to resist the shear forces between the metal portion of the cover and the supporting edge structure of the tank.

Figure 28:
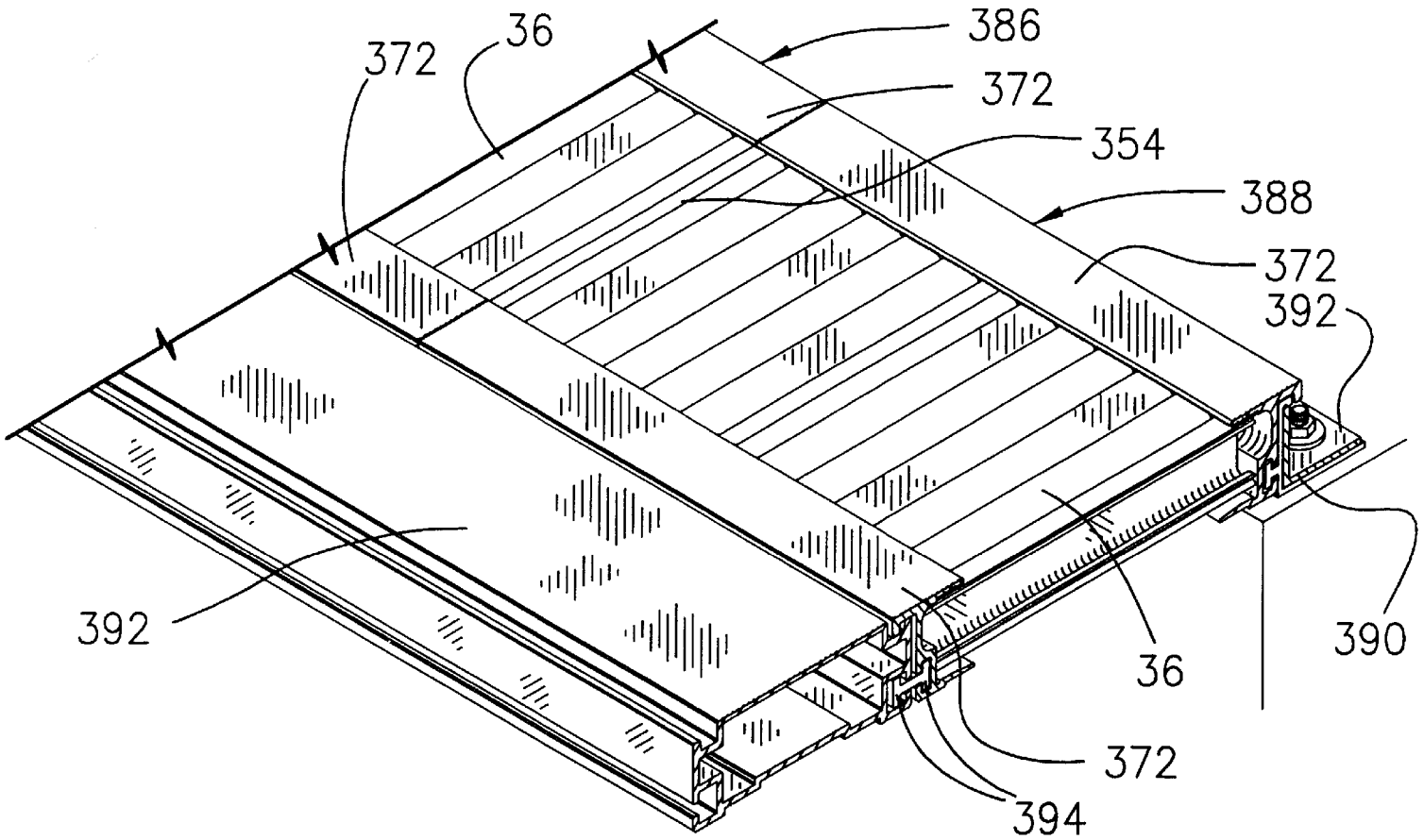
FIG. 28 is a perspective view, partially in section, showing an assembly in accordance with the invention, illustrating one form of seal and bearing strip at the edge of the structure.

FIG. 28 is a partially cut away view, partially in section, showing a portion of a cover assembly employing a similar side member 372 to that shown in FIG. 27. As in FIG. 25, the side members 372 preferably are discontinuous at joints between two adjacent panels 386 and 388. The interlocking panel splice strip 354 is seen between panels, securing together adjacent planks 36 of the adjacent panels. In this case a different sealing extrusion 390 is used, for the case of an irregular concrete surface on which the assembly bears. An aluminum (or other metal) angle or other structural member 392 bears down against the sealing strip 390, secured by appropriate fasteners. As with the extrusion 368 described relative to FIG. 27, this sealing extrusion 390 is configured to slide into connection with the extruded side member 372, and this strip can be continuous throughout the length of a side of the tank cover, or through several panels. In one embodiment and installation method of the invention, each sealing strip or extrusion 390 is separate for each panel, so that the entire panel, including the sealing strips, can be preassembled and the panels delivered to a job for efficient assembly.

The structure shown in FIG. 28 could be similar on the left side, as to the right side just described, for an installation similar to that of FIG. 25. However, FIG. 28 shows the left side members 372 as being connected to a cross member 392, i.e. a structural member which will support the cover and live load across a selected span. Thus, the support which was provided on both sides by the tank edge or rim structure in the embodiment of FIG. 25 is replaced by connection with the structural cross member 392. In this way, additional panels can be assembled side-by-side relative to FIG. 28, in the manner generally shown in FIGS. 1, 4B and 8 described earlier. In this case the cover is substantially flat, as opposed to the arched shapes shown in FIGS. 2 and 8. The drawing of FIG. 28 does not show a flexible connector extrusion engaged in side-by-side channels 394 of the two metal extrusions 372 and 392, but this is discussed below in connection with another drawing figure.

Figure 29:
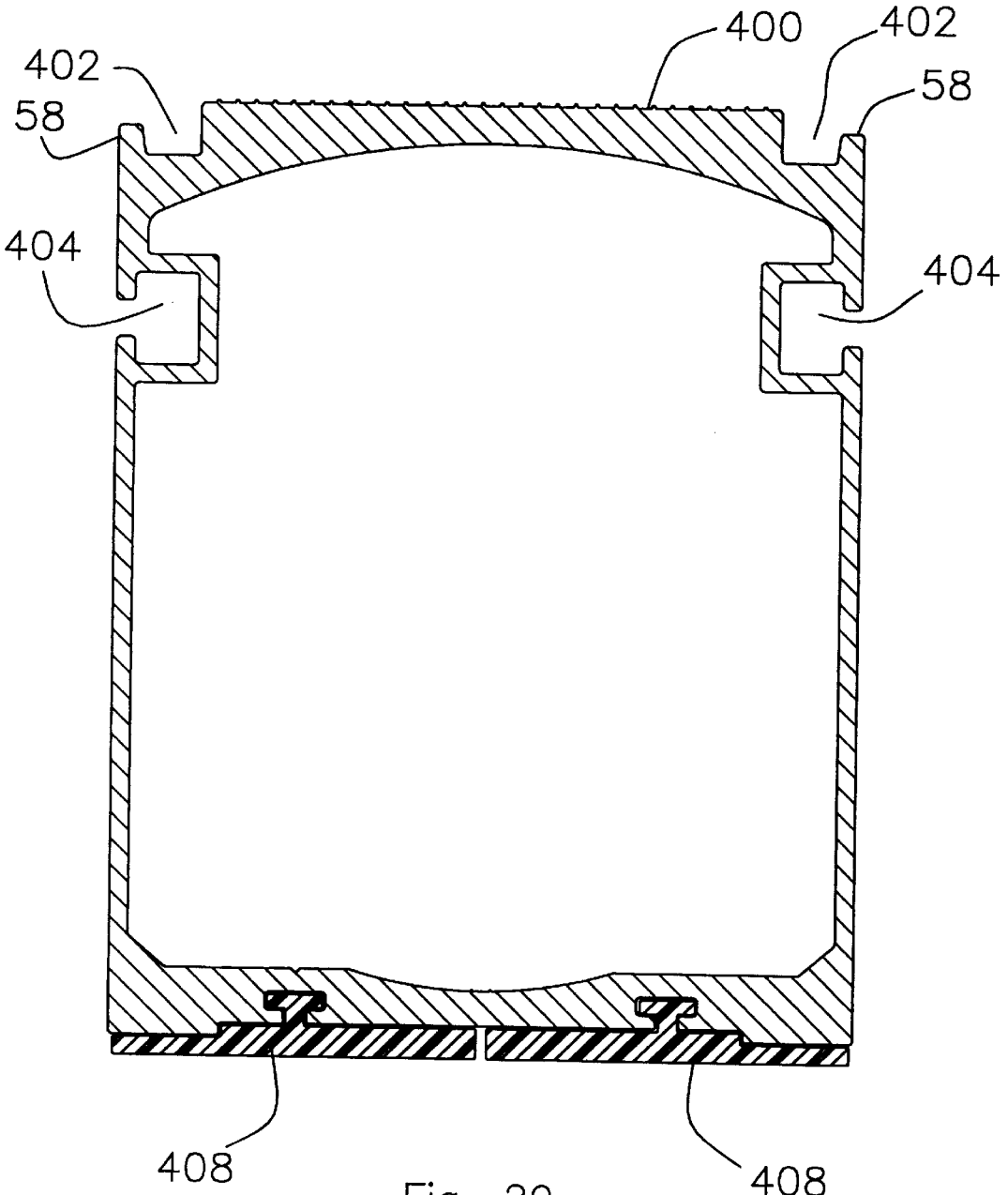
FIG. 29 is a cross-sectional view showing a structural beam which can form a part of the assembly of the invention, with extruded rubber-like pads slidingly fitted into ends of the beam.

FIG. 29 shows a particular structural cross member or beam 400 for use in some of the embodiments of the invention. The beam 400, which may be about 6 inches high and approximately 5½ inches wide, thus has a significant structural cross section and can be used alone in many cases, as opposed to the beam shown in FIG. 31, described below, wherein an added structural member is secured to a beam of the type generally shown in FIGS. 4A, 4B and 5, for example. The structural beam cross member 400 has a top hooking flange or ear 58 as in above described embodiments, forming a shoulder recess 402. Also formed in the extrusion 400 is a box-like recess or groove 404, functionally similar to the tunnel-shaped groove 64 shown in FIG. 4A. Thus, the structural beam or cross member 400 can be interchanged with a cross member 406 shown in FIG. 31, or the cross member 392 shown in FIG. 28, when the span length and load factors are appropriate for this structural beam.

Another important feature of the cross member beam 400 shown in FIG. 29 is provision for a pair of rubber or rubber-like pads 408 which slide into extruded channels formed in the bottom of the structural beam 400. These pads 408 are placed only in the bearing areas at the ends of the beam 400 (or in any other bearing area), to isolate the preferably metal beam 400 from contact with other metal or concrete as installed and also to act as seals. The pads 408 could be a single pad if desired, but, as shown in FIG. 30, the use of two separate pads allows a half-section of the beam 400, shown at 410 in FIG. 30, to use one of the rubbery pads 408 on its bottom surface as indicated in FIG. 30, the same pads 408 serve in both capacities, for either the beam 400 or the modified half-section 410.

Figure 30:
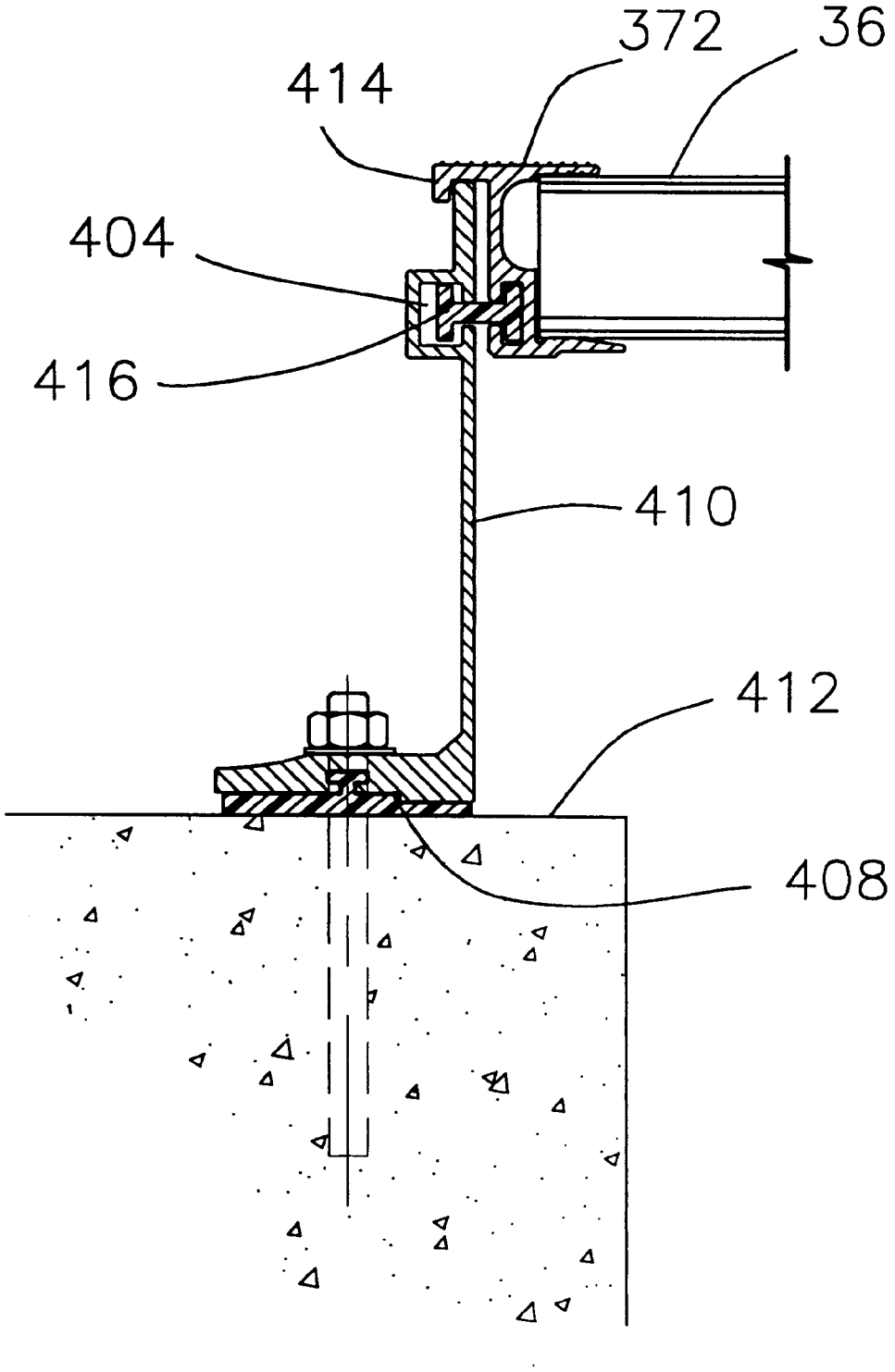
FIG. 30 is a cross-sectional view in elevation showing a side connection for a tank or channel cover structure.

FIG. 30 shows a detail which can be used at sides of a tank cover installation, i.e. at the ends of the individual planks 36, one of which is shown in FIG. 30. As usual, a side member 372 receives the ends of the planks 36, forming the edge of a panel and providing a member which can be supported via the rim or edge 412 of the open-topped tank or channel. As discussed above, the modified half-section 410, having many extruded portions similar to the structural cross member 400 of FIG. 29, connects to the side member 372 in a standard fashion for the types of fittings and components shown in FIGS. 26–32. The side member 372 has a downwardly hooking flange 414 which engages over a top edge of the structural member 410, while a flexible plastic locking member or interlocking seal strip 416, of a resilient plastic material such as the material ELVAX 670 discussed above, similar to the dumbbell-shaped interlocking seal strip 72 shown in earlier embodiments, FIG. 4B, as an example. The locking member or interlocking seal strip 416 engages in a channel or cavity of the side member 372 relatively closely, but fits in the rectangular cavity 404 of the member 410 with a horizontal tolerance, e.g. about ¼ inch. This permits a lateral tolerance for thermal expansion movement of about 3⁄16 inch maximum. As can be seen from FIG. 30, the downwardly hooking flange 414 provides this same tolerance at the upper end of the side member 372. Under load of the assembled cover, the seal strip 416 seals the assembly substantially gas tight.

As noted above, FIG. 30 shows a rubbery pad extrusion 408 which has been slidingly connected into the bottom of the structural member 410, and the member 410 is secured down to the rim or edge structure 412 of the channel with appropriate fasteners. The reason for the height of the member 410, which spaces the deck planks 36 considerably above the rim or edge 412 of the tank, is to accommodate the height of a beam such as the beam 400 shown in FIG. 29. Such a beam will rest on edges of the channel or tank which are at right angles to the edge 412 shown in FIG. 30.

Figure 31:
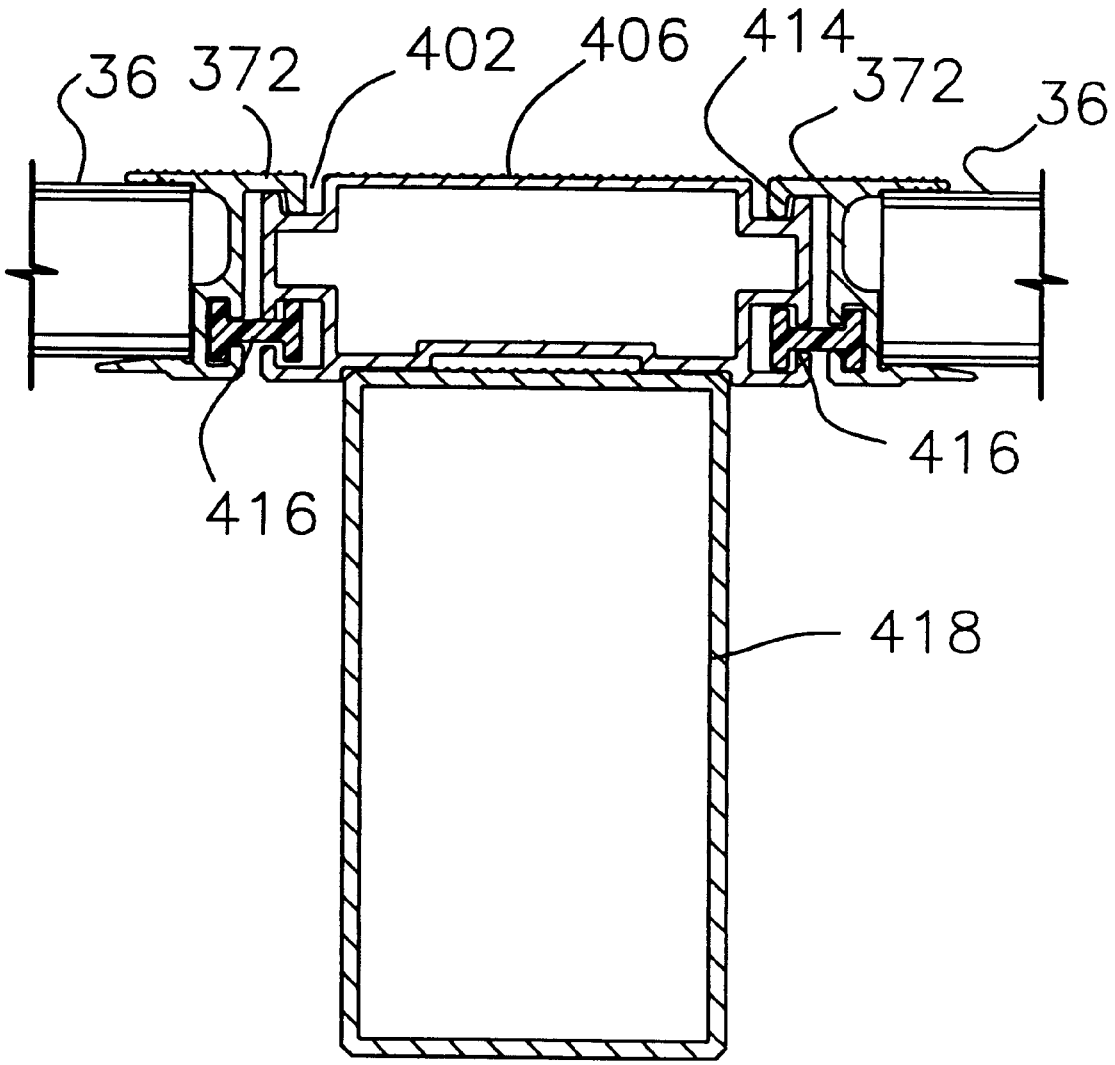
FIG. 31 is a cross-sectional view in elevation showing a structural cross member as connected to panels on either side, built up with a deeper structural section for long spans.

FIG. 31 includes additional components which fit within the system of the invention as described in FIGS. 26–32. In this case a cross member 406 is built up with a box beam 418 which is assembled to the cross member 406 by means of welded connection. Additional beams can be added, either below the beam 418 or on top of the cross member 406, or both, by welded connections. This is determined by the particular span and specified loading conditions for the tank cover structure application. The assembly shown in FIG. 31 includes side members 372 of the same type described above, with interlocking seal strips 416 which interlock the cross member 406 to the side members 372 at a lower level, while the downwardly hooking flanges 414 allow similar lateral expansion tolerance resting in a recess 402 defined by an ear or flange 58, in the same way as described above relative to FIG. 29. As mentioned above, these components are interchangeable regardless of the cross section selected for the cross member 406 or the beam 400, etc. Deck planks 36 are also shown in FIG. 31, received in the other sides of the side members 372.

Figure 32:
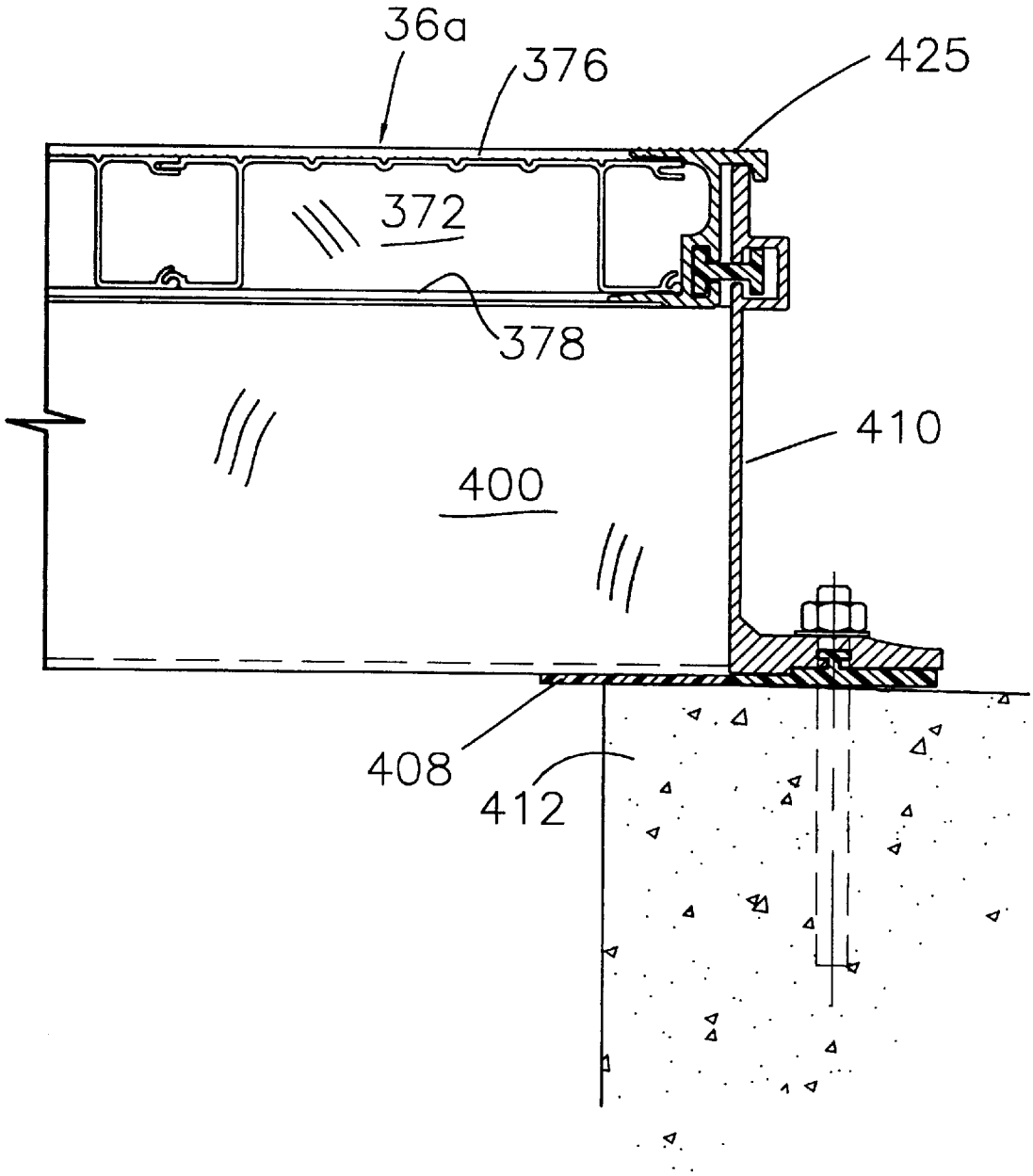
FIG. 32 is a cross-sectional detail view in elevation, showing a preferred arrangement for closing and sealing the ends of a cover structure, where the deck planks run parallel to the tank rim or edge.

FIG. 32 complements FIG. 30, in showing one preferred arrangement for the ends of a tank cover structure, i.e. where the deck planks 36 are parallel to the tank edge or rim 412. FIG. 32 shows a wider deck plank or slat 36 than is shown in other drawing views, illustrating that these deck planks can be formed in different widths. The function of the arrangement shown in FIG. 32 is primarily to close and seal the tank cover structure with the tank edge structure 412, for relatively large tank cover structures involving multiple panels and where cross members, i.e. structural beams, are necessary, as opposed to the more simply supported structure shown in FIG. 25.

FIG. 32 shows a modified half-section member 410 similar to that shown in FIG. 30, but this time running parallel to the deck planks 36*a*. A structural beam cross member 400 is seen beyond, the planks 36*a* being framed into this beam via a side member 372 whose upper and lower flanges 376 and 378 are seen in FIG. 32. This side member 372 is butted against a special member 425 which is similar in cross section to the side members 372, but which preferably is formed of a flexible plastic material such as Santoprene, referenced above. The function of the special member 425 and of the modified half-section 410 in FIG. 32, is to close and seal the end of the beam and panel, as the beam and panel relate to the edge or rim 412 of the tank. Thus, the plastic section 425 provides an efficient seal, while also being removable in the field, since adhesives need not be used.

Regarding FIG. 32, the importance of field removability of the special member 425 is in the ability to open up the end area at the member 410 and to take out certain or all panels of the cover. It is an important feature of the invention that, although adhesives are used to connect planks into side members and optionally can be used for connecting adjacent planks, this is within a single panel, and panels preferably are not connected by adhesive to adjacent panels or to cross members. Preferred adhesives are high-temperature silicone adhesive or a urethane adhesive. Within a specific panel, the use of adhesive is the primary method of securing the panel together via its side members (although it is sometimes convenient to use tack welding to hold certain members together within a panel for the completion of fabrication of the panel). Thus, with panels being prefabricated at the manufacturing plant, field erection techniques preferably do not involve gluing or welding. In the assemblies of the invention, welding is generally limited to the fabrication of tall structural beam sections for long spans.

Another important feature of the invention is that the seals, e.g. the interlocking seal strips 72 and 416, the seal member 110B, the interlocking panel splice strip 360, the edge seal strips 368 and 390, the isolator seal pads 408, and the special strip 425, all are slidingly fitted into the metal sections. Thus, these sealing members are replaceable without the use of special tools.

In summary, embodiments of a field-erectable modular lightweight tank cover have been described. Components and component attachment methods are described which are common to different cover shapes and sizes. A majority of components may be conveniently fabricated from aluminum extrusions of relatively small section. Components of a cover may be packed into a container having a small volume relative to the dimension of the assembled cover. This, together with the lightness provided by the use of aluminum components, assists in reducing shipping costs. Further, extensive use of weldless interlocking connections between components may reduce field erection time and cost to less than half of the cost and time associated with more traditional structures and assembly methods.

The present invention has been described in terms of preferred and other embodiments. The present invention, however, is not limited to those embodiments described and depicted. Rather, the invention is defined by the appended claims.

I claim:

1. In a cover for an open-topped structure such as a tank having a cover supporting rim or edge, the cover including at least two panels in adjacent side-by-side relationship, and each panel comprising a plurality of extruded planks connected together edge-to-edge with tongue-in-groove means for connecting plank edges, the tongue-in-groove means at each panel edge defining a channel extending continuously lengthwise in the extruded plank and open at its edge, so as to face a similar open channel of an adjacent plank, a connection joint between adjacent panels, comprising:

each panel, at its edge facing an adjacent panel, having one of said planks as an edge plank, with said open channel facing toward a similar open channel of an edge plank of the adjacent panel, with the edge planks of the adjacent panels spaced apart, and an interlocking panel splice strip engaged between and in the two facing channels of the two edge planks of adjacent panels, the panel splice strip being closely fitted into each of said two channels and comprising a rubber-like, flexible plastic extrusion.

2. The apparatus of claim 1, wherein the interlocking panel splice strip comprises an extrusion having engagement means for engaging with the tongue-in-groove means of at least one of the edge planks of the adjacent panels.

3. The apparatus of claim 2, wherein the interlocking panel splice strip includes a bullnose protrusion engaged in the channel opposite said tongue-in-groove means of said one edge plank, fitting closely within the channel.

4. The apparatus of claim 1, wherein the interlocking panel splice strip includes a top portion which fits between top edges of the two adjacent, spaced apart planks of the two adjacent panels, so as to fill in the space between the two planks and to form a generally flush surface across the two adjacent panels.

5. The apparatus of claim 1, wherein the interlocking panel splice strip is formed of the material ethyl vinyl acetate.

6. The apparatus of claim 1, wherein the interlocking panel splice strip is positioned and configured to support shear loading at edges of the adjacent panels.

7. The apparatus of claim 6, wherein the interlocking panel splice strip fits sufficiently closely within the two adjacent channels of the two adjacent planks to provide a substantially gas-tight seal between the two adjacent panels.

8. In a cover for an open-topped structure such as a tank having a cover supporting rim or edge, the cover including a series of metal extrusions connected together, an improved structural joint between two adjacent extruded structural members, comprising:

a first of said structural members having at a top side of the structural member a horizontal extension terminating in a downwardly hooking flange, and said first structural member having a generally rectangular cavity extending lengthwise in the extruded structural member, the cavity having a slot-like opening, continuous throughout the extruded structural member and facing toward a second of said two structural members, the second structural member having an upper side with an upwardly extending lip or flange, substantially continuous through the length of the extrusion, and the second structural member also including a generally rectangular cavity extending through the length of the extrusion and having a continuous slot-like opening facing toward the slot-like opening in the generally rectangular cavity of the first structural member, the first and second structural members being adjacent and in contact such that upper portions of the first and second structural members are interlocked by the horizontal extension with its downwardly hooking flange of the first structural member hooking over and resting on the upwardly extending lip or flange at the top of the second structural member, thereby supporting the first structural member on the second structural member and preventing the two structural members from pulling apart, and an elongated H-shaped interlocking seal strip of resilient plastic material and having two opposed generally parallel flanges and a perpendicular connecting web engaged with the first and second structural members, the two opposed flanges of the H-shaped seal strip being positioned one in each of the generally rectangular cavities of the first and second structural members and the connecting web extending through the slot-like openings of the generally rectangular cavities and spanning between the generally rectangular cavities so as to provide further structural strength in the connection between structural members and further to prevent pulling apart of the two structural members.

9. The apparatus of claim 8, wherein the generally rectangular cavity in the second structural member has an internal width substantially wider than the web of the H-shaped seal strip which is positioned in the cavity, thus allowing for some lateral movement between the two connected structural members, as for expansion and contraction.

* * * * *